US008398093B2

(12) United States Patent
Boucher

(10) Patent No.: US 8,398,093 B2
(45) Date of Patent: Mar. 19, 2013

(54) FRAME FOR AN IN-LINE ROLLER SKATE HAVING A MOVABLE WHEEL-RECEIVING ELEMENT

(75) Inventor: Marc-André Boucher, Lac-Beauport (CA)

(73) Assignees: Guy Beaudry, St-Henri, Quebec (CA); Francois Beaudoin, St-Cyrille-de-Wendover, Quebec (CA)

( * ) Notice: Subject to any disclaimer, the term of this patent is extended or adjusted under 35 U.S.C. 154(b) by 631 days.

(21) Appl. No.: 12/187,660

(22) Filed: Aug. 7, 2008

(65) Prior Publication Data

US 2009/0045596 A1 Feb. 19, 2009

Related U.S. Application Data

(60) Provisional application No. 60/963,672, filed on Aug. 7, 2007.

(51) Int. Cl.
*A63C 17/06* (2006.01)

(52) U.S. Cl. ..... 280/11.28; 280/11.225

(58) Field of Classification Search ..... 280/11.19, 280/11.223, 11.224, 11.225, 1.27, 11.28, 280/11.27
See application file for complete search history.

(56) References Cited

U.S. PATENT DOCUMENTS

| | | | | |
|---|---|---|---|---|
| 4,132,425 | A | 1/1979 | Lehner et al. | |
| 5,405,156 | A * | 4/1995 | Gonella | 280/11.28 |
| 5,486,011 | A * | 1/1996 | Nelson | 280/11.207 |
| 5,503,413 | A * | 4/1996 | Belogour | 280/11.225 |
| 5,513,862 | A * | 5/1996 | Chuang | 280/11.231 |
| 5,566,957 | A | 10/1996 | Ho | |
| 5,582,418 | A | 12/1996 | Closser | |
| 5,690,344 | A | 11/1997 | Chen | |
| 5,704,621 | A | 1/1998 | Lazarevich et al. | |
| D408,882 | S | 4/1999 | Hilgarth | |
| 5,890,724 | A | 4/1999 | Gignoux et al. | |
| 5,927,728 | A | 7/1999 | Gignoux et al. | |
| 5,938,213 | A | 8/1999 | Gignoux | |
| 5,979,916 | A | 11/1999 | Gatel et al. | |
| 6,017,041 | A | 1/2000 | Gignoux | |
| 6,053,512 | A | 4/2000 | Chang | |
| D426,864 | S | 6/2000 | Chang | |
| 6,196,557 | B1 | 3/2001 | Gerard | |
| 6,227,551 | B1 | 5/2001 | Roy | |
| D445,159 | S | 7/2001 | Mayer, II et al. | |
| 6,276,696 | B1 | 8/2001 | Wong | |
| 6,450,510 | B1 | 9/2002 | Liu | |

(Continued)

FOREIGN PATENT DOCUMENTS

| | | |
|---|---|---|
| EP | 0 754 478 A2 | 1/1997 |
| EP | 0 774 282 A1 | 5/1997 |

(Continued)

*Primary Examiner* — Frank Vanaman
(74) *Attorney, Agent, or Firm* — Ladas & Parry LLP

(57) ABSTRACT

An in-line roller skate having a shoe and a wheel supporting frame extending therefrom for supporting aligned wheels. The frame includes a main frame body mounted to the shoe and at least one auxiliary frame body for supporting a wheel and being pivotally mounted to the main frame body. A resilient and deformable member is interposed between the auxiliary frame body and the shoe. The auxiliary frame body is so pivotable as to provide for moving the wheel towards and away the shoe for a distance determined by the extension and compression of the resilient and deformable member.

23 Claims, 18 Drawing Sheets

U.S. PATENT DOCUMENTS

| | | | | |
|---|---|---|---|---|
| 6,478,313 | B1 | 11/2002 | Gray | |
| 6,481,726 | B2 | 11/2002 | Alfieri et al. | |
| 6,561,525 | B1 * | 5/2003 | Chou | 280/11.221 |
| 2001/0006282 | A1 * | 7/2001 | Green et al. | 280/11.225 |
| 2002/0105150 | A1 | 8/2002 | Liao et al. | |
| 2003/0102641 | A1 | 6/2003 | Liu | |
| 2004/0239058 | A1 | 12/2004 | Barnes et al. | |
| 2005/0127621 | A1 | 6/2005 | Durocher | |
| 2008/0012249 | A1 | 1/2008 | von Detten | |

FOREIGN PATENT DOCUMENTS

| | | | |
|---|---|---|---|
| EP | 0 810 010 | A2 | 12/1997 |
| EP | 0 710 141 | B1 | 7/1999 |
| EP | 1 053 771 | A2 | 11/2000 |
| EP | 1 112 698 | A2 | 7/2001 |

* cited by examiner

FRAME FOR AN IN-LINE ROLLER SKATE HAVING A MOVABLE WHEEL-RECEIVING ELEMENT

CROSS-REFERENCE TO RELATED APPLICATIONS

The present application claims priority on U.S. Provisional Application Ser. No. 60/963,672 filed on Aug. 7, 2007 and incorporated herein by reference in its entirety.

FIELD OF THE INVENTION

The present invention generally relates to an in-line roller skate. More specifically but not exclusively, the present invention relates to a frame for an in-line roller skate.

BACKGROUND OF THE INVENTION

Typically, in-line skates include a boot or a shoe which is worn on the foot. The show is attached to a frame which holds the wheels in line. Bearings allow the wheels to rotate freely around the axles. The frames include wheel-receiving elements having a pair of arms for receiving the wheels therebetween. Typically, the wheel receiving elements of an in-line skate are rigidly attached to the frame. Even though frames are made of rigid and malleable plastic, this configuration prevents the frame from being sufficiently flexible during skating. Due in part to this drawback, a sideway movement of either the front or rear wheels often causes the skate to leave the ground resulting in the skater falling.

Improvements to rigid single piece frames includes a main frame body with a pair of longitudinal arms secured thereto to via a spring and a pivot in order to carry wheels so as to allow upward and downward movement of the wheels relative to the main frame. Other like improvements included bogeys pivotally mounted to a main frame and carrying wheels.

A drawback of the above briefly mentioned frames which include auxiliary wheel-carrying elements pivotally mounted to a main frame is that the pivotal movement is not smooth. Other systems provide a variety of complicated spring mechanisms for addressing the foregoing problem yet these systems are complex and costly and do not provide a sufficiently smooth pivot

OBJECTS OF THE INVENTION

It is an object of the present invention to provide a frame for an in-line roller skate.

It is an object of the invention to provide a wheel-receiving member for an in-line roller skate.

It is an object of the present invention to provide an in-line roller skate.

SUMMARY OF THE INVENTION

In accordance with an aspect of the present invention, there is provided an in-line roller skate comprising: a shoe; and a wheel supporting frame extending from said shoe for supporting aligned wheels and comprising: a main frame body mounted to said shoe; at least one auxiliary frame body for supporting a wheel and being pivotally mounted to said main frame body; and a resilient and deformable member interposed between said auxiliary frame body and said shoe, wherein said at least one auxiliary frame body is so pivotable as to provide for moving said wheel towards and away said shoe for a distance determined by the extension and compression of said resilient and deformable member.

In accordance with an aspect of the present invention, there is provided a wheel-supporting frame for an in-line skate having a shoe, said frame comprising: a main frame body mountable to said shoe; at least one auxiliary frame body for supporting a wheel and being pivotally mounted to said main frame body; and a resilient and deformable member for being interposed between said auxiliary frame body and the shoe, wherein said at least one auxiliary frame body is so pivotable as to provide for moving said wheel towards and away said shoe for a distance determined by the extension and compression of said resilient and deformable member.

In accordance with an aspect of the present invention, there is provided an in-line roller skate comprising: a shoe; and a wheel supporting frame extending from said shoe for supporting aligned wheels and comprising: a main frame body mounted to said shoe and comprising at least one portion thereof having a wheel rotably mounted to a shaft; and at least one auxiliary frame body for supporting another wheel and being pivotally mounted to said main frame portion shaft, wherein said at least one auxiliary frame body is so pivotable as to provide for moving said wheel towards and away said shoe.

In accordance with an aspect of the present invention, there is provided a wheel supporting frame for an in-line roller skate having a shoe, said frame comprising: a main frame body mountable to the shoe and comprising at least one portion thereof having a wheel rotably mounted to a shaft; and at least one auxiliary frame body for supporting another wheel and being pivotally mounted to said main frame portion shaft; and wherein said at least one auxiliary frame body is so pivotable as to provide for moving said wheel towards and away said shoe.

In accordance with an aspect of the present invention, there is provided an auxiliary frame body for an in-line roller skate having a show and a main frame body extending therefrom, said auxiliary frame body comprising: a pair of lateral sides defining a first pair of arms and an opposite second pair of arms, said first pair providing to receive a wheel therebetween, said second pair of arms being pivotally mountable to a portion of the main frame body; and a linking member between said lateral sides.

According to an aspect of the invention there is provided a wheel-supporting frame for an in-line roller skate having a shoe, said wheel-supporting frame comprising: a shoe-mounting side for being mounted to the shoe; and a wheel-supporting side opposite to said shoe-mounting side, said wheel-supporting side comprising aligned wheel-receiving elements for receiving respective roller skate wheels, wherein at least one of said wheel-receiving elements is pivotable along a predetermined angle about an axis generally orthogonal to the longitudinal axis of said frame.

According to an aspect of the invention there is provided an in-line roller skate comprising: a shoe; and a wheel-supporting frame mounted to said show and comprising: a shoe-mounting side for being mounted to the shoe; and a wheel-supporting side opposite to said shoe-mounting side, said wheel-supporting side comprising aligned wheel-receiving elements for receiving respective roller skate wheels, wherein at least one of said wheel-receiving elements is pivotable along a predetermined angle about an axis generally orthogonal to the longitudinal axis of said frame.

According to an aspect of the invention, there is provided a wheel-supporting member for an in-line skate having a shoe and a frame body at the underside of the shoe for mounting said wheel-supporting member thereto, said wheel-supporting member comprising: a wheel-receiving element for receiving a roller skate wheel and having mounting elements for being pivotally mounted to the frame body so as to be pivotable along a predetermined angle about an axis generally orthogonal to the longitudinal axis of the frame body.

The foregoing and other objects, advantages and features of the present invention will become more apparent upon reading of the following non-restrictive description of illustrative embodiments thereof, given by way of example only, with reference to the accompanying drawings.

BRIEF DESCRIPTION OF THE DRAWINGS

In the appended drawings, where like reference numeral indicate like elements throughout and in which.

DETAILED DESCRIPTION OF ILLUSTRATIVE EMBODIMENTS

Generally stated, the invention, in an embodiment thereof relates to a frame for an in-line roller skate. The frame includes main frame body and an auxiliary frame body pivotally mounted to the main frame body defining a plurality of wheel-receiving elements having a pair of arms for receiving wheels therebetween. At least one of these wheel-receiving elements that extend from the auxiliary frame body is a pivotable about an axis that is generally orthogonal to the longitudinal axis of the frame so that this at least one wheel-receiving element (along with the wheel it carries) is upwardly and downwardly movable within a predetermined angle range or distance towards and away from the shoe. This predetermined angle range is provided by the extension and compression of a resilient and deformable member interposed between the auxiliary frame body and the shoe. The invention, in an embodiment thereof, also generally relates to in-line roller skates with such frames as well as to wheel-receiving elements that are so pivotable.

With reference to FIGS. 1 to 6, a wheel-supporting frame 10 for an in-line roller skate according to a non-restrictive illustrative embodiment of the present invention will now be described.

Figure 1:
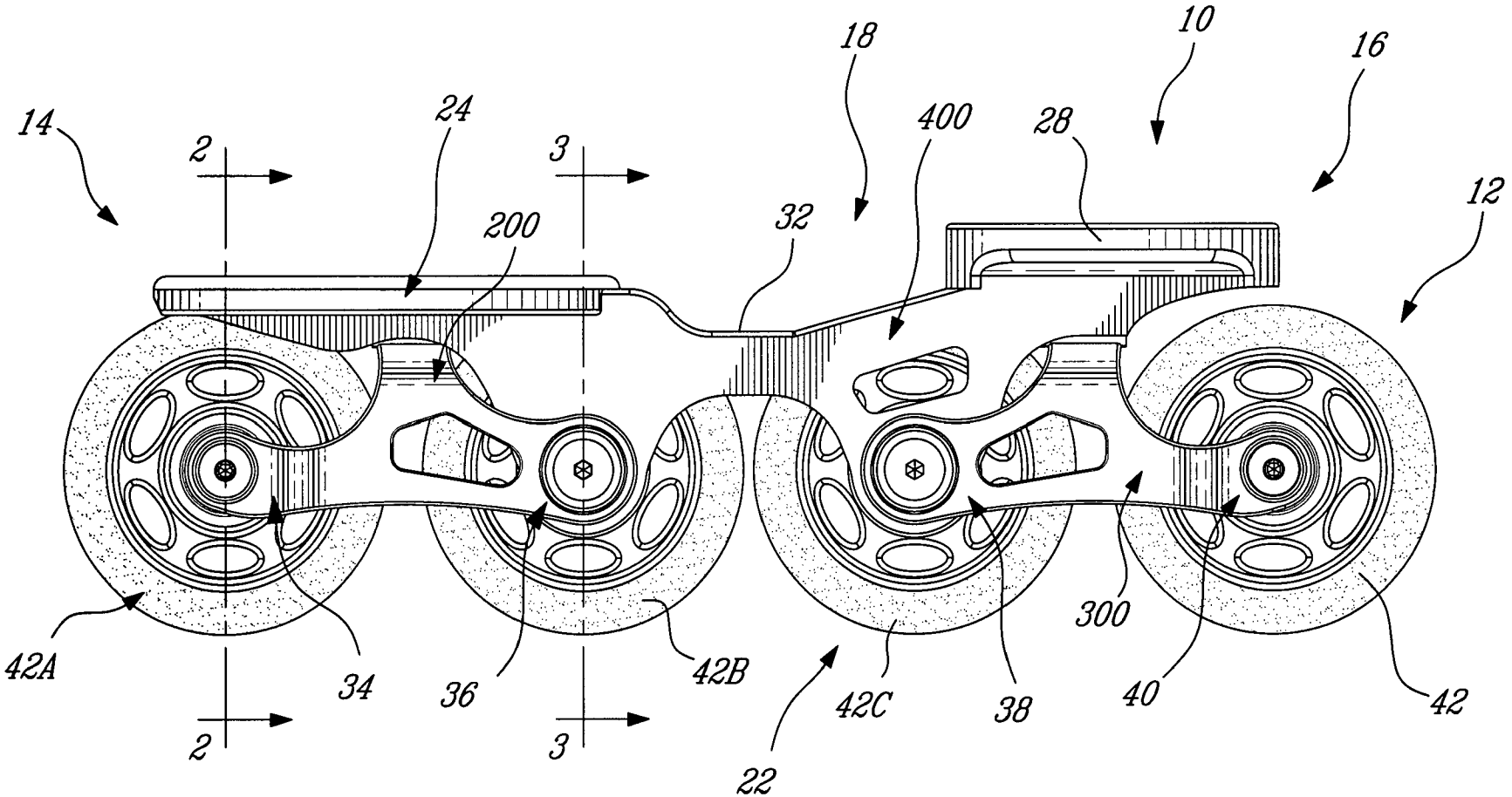
FIG. 1 is a side elevational view of a wheel-supporting frame for an in-line roller skate according to a non-restrictive illustrative embodiment of the present invention.
Figure 5:
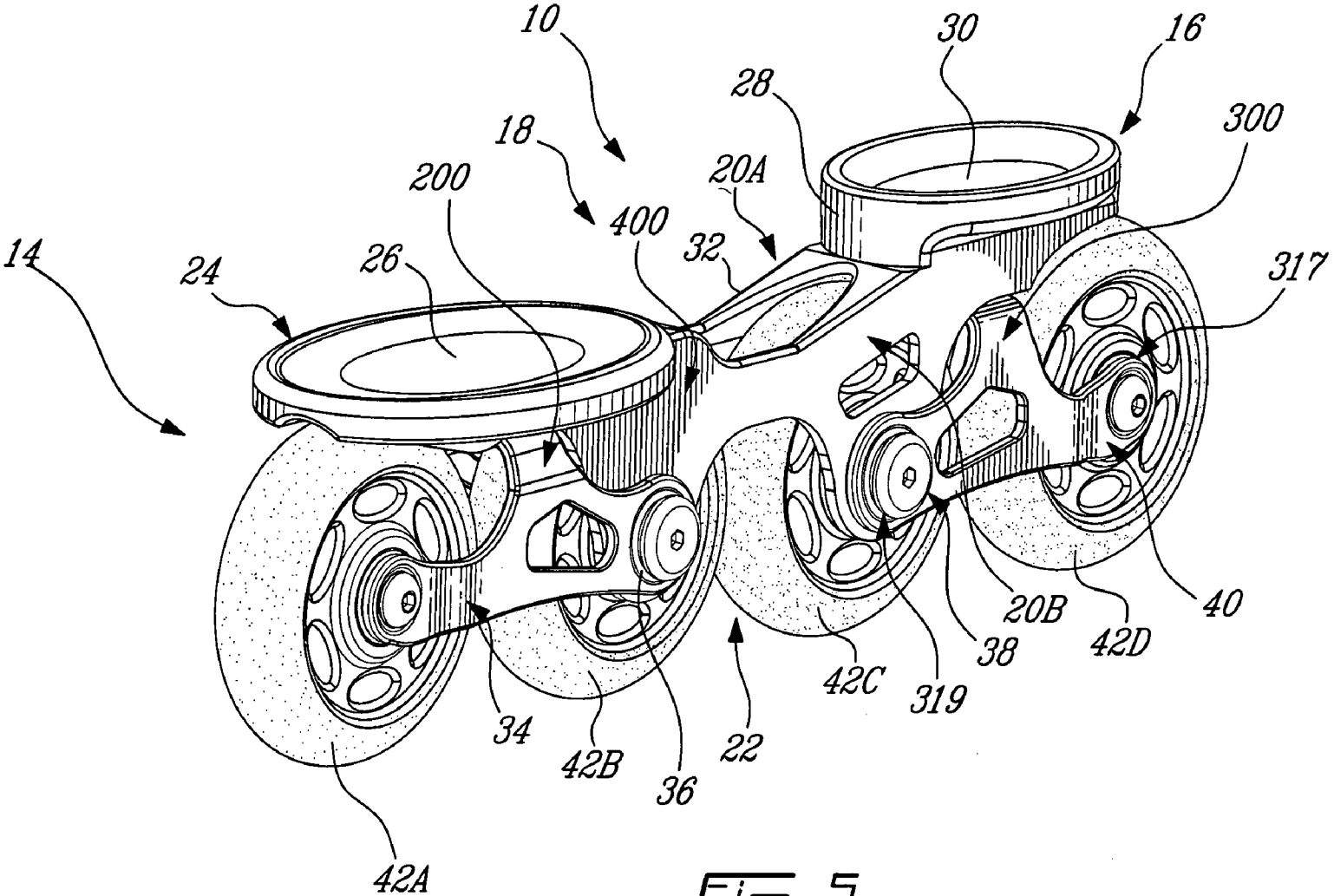
FIG. 5 is a perspective view of the wheel-supporting frame of FIG. 1.

FIGS. 1 and 5 show the wheel-supporting frame 10 generally defining a longitudinal axis 12 (only shown in FIG. 1) extending from a front end 14 thereof to a rear end 16 thereof. The wheel-supporting frame 10 comprises a shoe-mounting side 18 for being mounted to footwear such as a boot or a shoe (so as to extend therefrom) and a wheel-supporting side 22 opposite the shoe-mounting side 18 for rotatably mounting wheels thereto. Turning to FIG. 5 in particular, the wheel-supporting frame 10 also includes opposite lateral sides 20A and 20B.

The shoe-mounting side 18 has a front basis 24 located at the front end 14 including a top surface 26. Similarly, the shoe-mounting side 18 has a rear basis 28 located at the rear end 16 including a top surface 30. The shoe-mounting side 18 also includes a median portion 32 between the front basis 24 and the rear basis 28.

The wheel-supporting frame 10 comprises a plurality of wheel-receiving elements, in this case there are four such elements, namely-receiving elements 34, 36, 38 and 40, each being configured to receive a respective wheel 42A, 42B, 42C and 42D. The wheel-receiving elements 34, 36, 38 and 40 are generally aligned to provide for the wheels 42A, 42B, 42C and 42D to be aligned as is known in the art. In this example, wheel 42A is the leading wheel and wheel 42D is the trailing wheel. Wheel-receiving elements 34 and 36 form part of a front wheel receiving member 200 positioned at the front end 14 of the wheel-supporting frame 10. Wheel-receiving elements 38 and 40 form part of a rear wheel-receiving member 300 positioned at the rear end 16 of the wheel-supporting frame 10. Hence, the front wheel-receiving member 200 receives wheels 42A and 42B and the rear wheel-receiving member 300 receives wheels 42C and 42D. The wheel-receiving member 200 and 300 are separate bodies mounted to the main longitudinal body 400 of the wheel-supporting frame 10.

In this example, the wheel-receiving frame 10 is an assembly formed of three bodies, the main frame body 400 and the wheel-receiving members or auxiliary frame bodies 200 and 300 mounted thereto.

Figure 4:
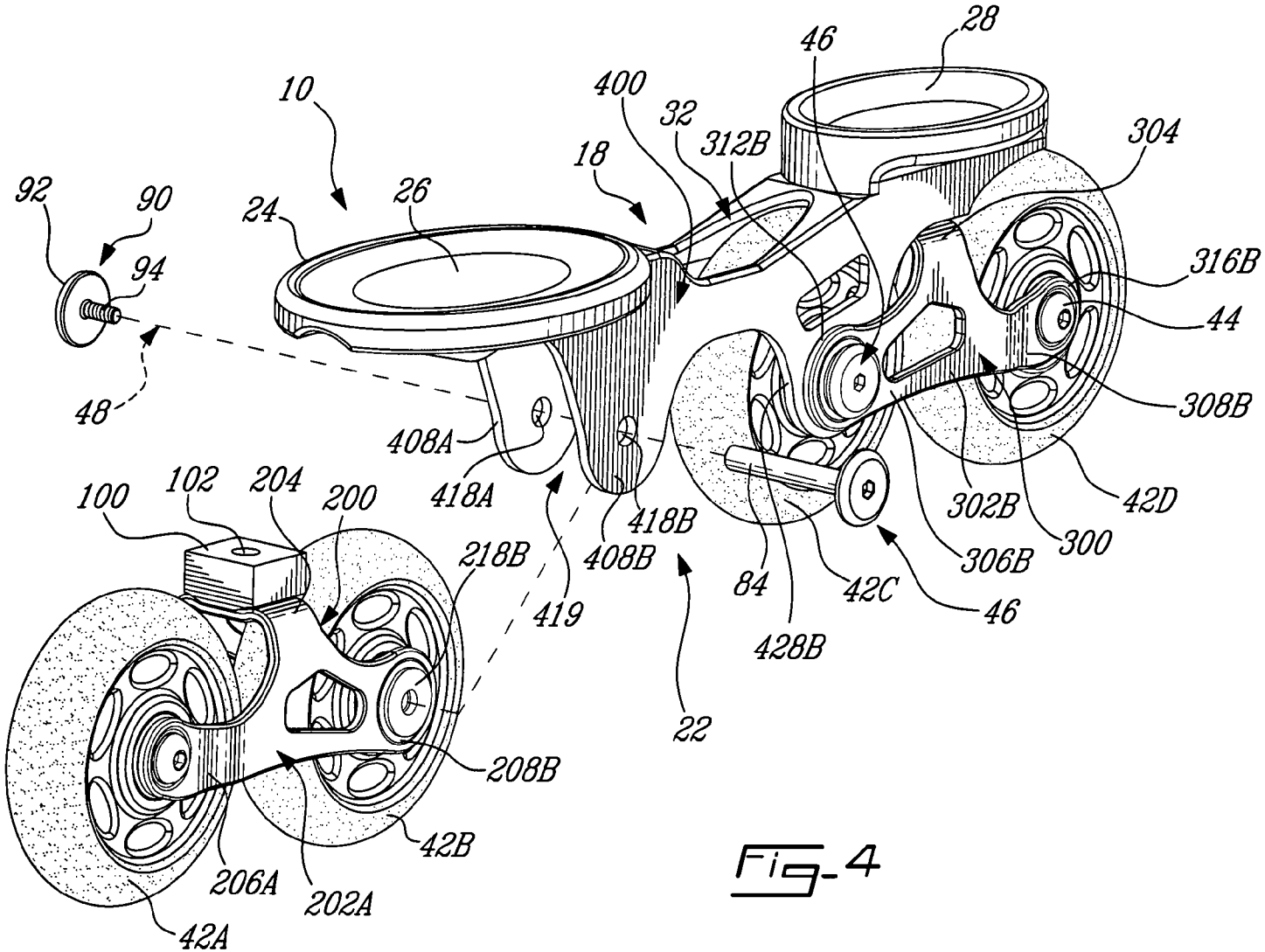
FIG. 4 is a partially exploded perspective view of the wheel-supporting frame of FIG. 1.
Figure 6:
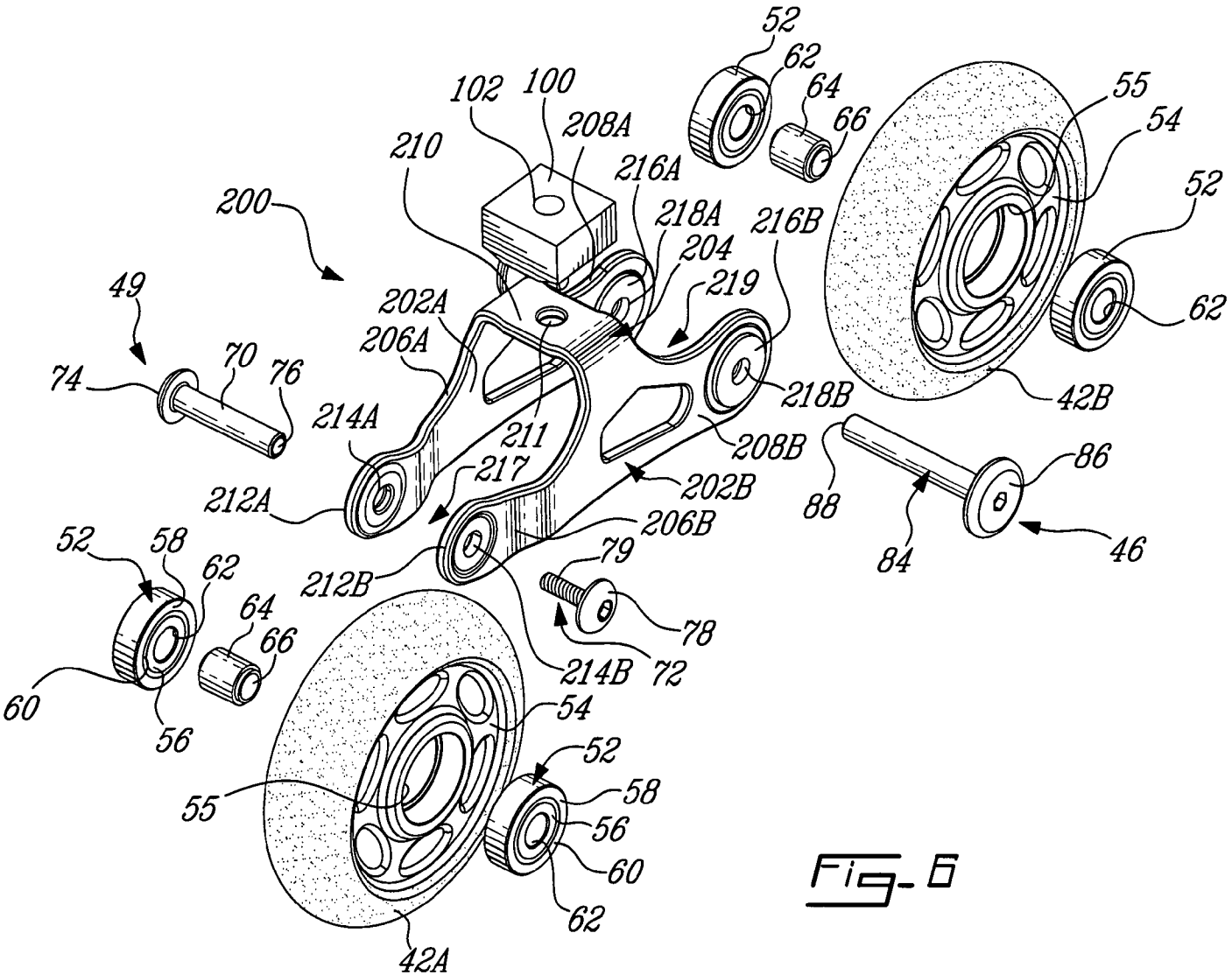
FIG. 6 is an exploded perspective view of wheel-receiving member of the wheel-supporting frame of FIG. 1.

With particular reference to FIGS. 4 and 6, the front wheel-receiving member or auxiliary frame body 200 is provided in the form of a rack defined by two oppositely directed generally U-shaped portions. The rack 200 includes a pair of lateral sides 202A and 202B joined together via linking-member 204. The lateral sides 202A and 202B define a pair of wheel-receiving arms 206A and 206B, defining the wheel-receiving element 34, and a second pair of receiving arms 208A and 208B, defining the wheel-receiving element 36. The linking-member 204 includes a top surface 210 thereof having a central hole 211. The first pair of arms 206A and 206B include respective front plates 212A and 212B at their free ends. Each plate 212A and 212B provides a respective hole 214A and 214B for receiving a first pivot axle 44. Similarly, the second pair of arms 208A and 208B include respective front plates 216A and 216B at their free ends with each plate 216A and 216B providing a respective hole 218A and 218B for receiving a second pivot axle 46.

Figure 2:
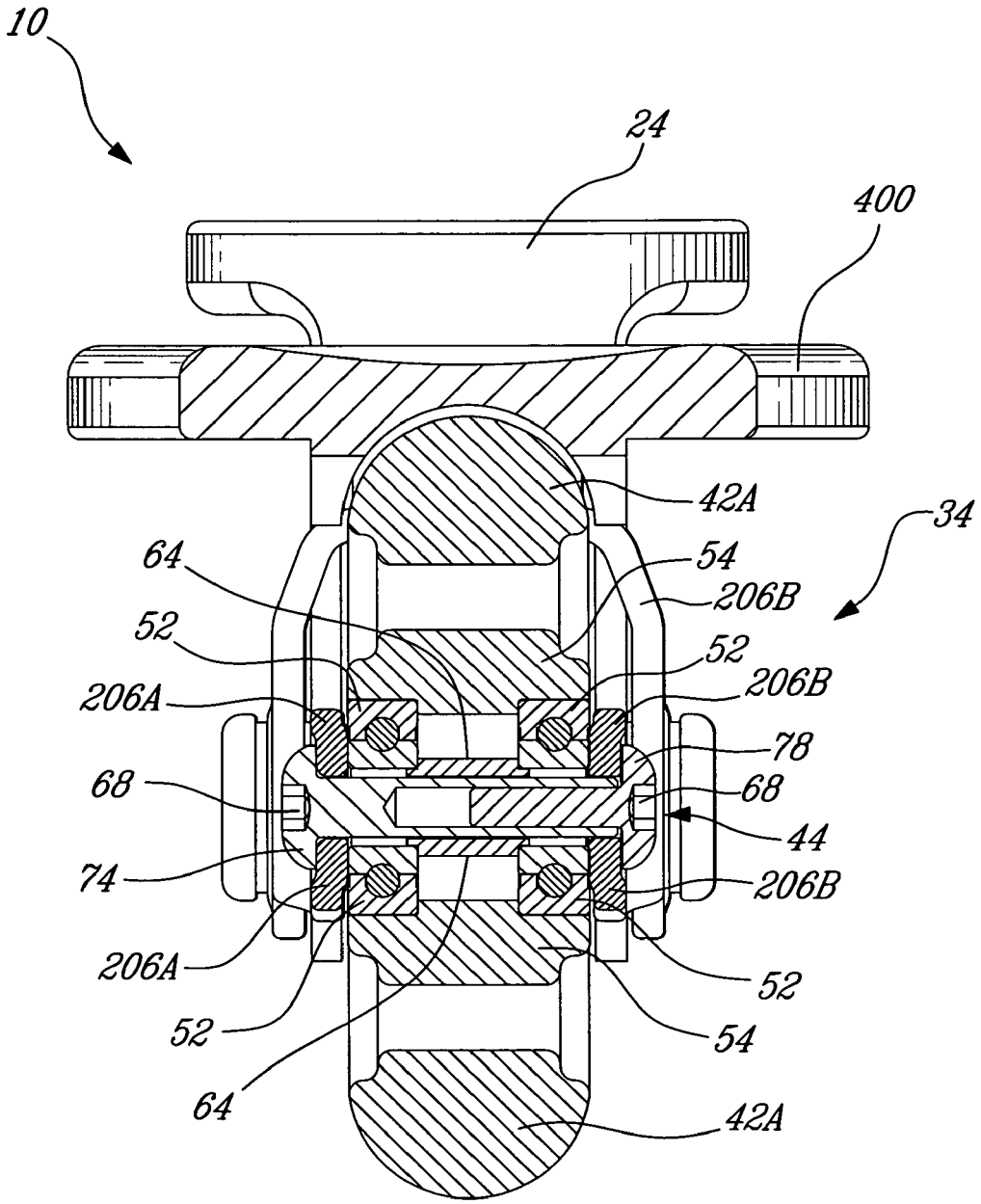
FIG. 2 is a cross-sectional elevational view taken along the line 2-2 of FIG. 1.
Figure 3:
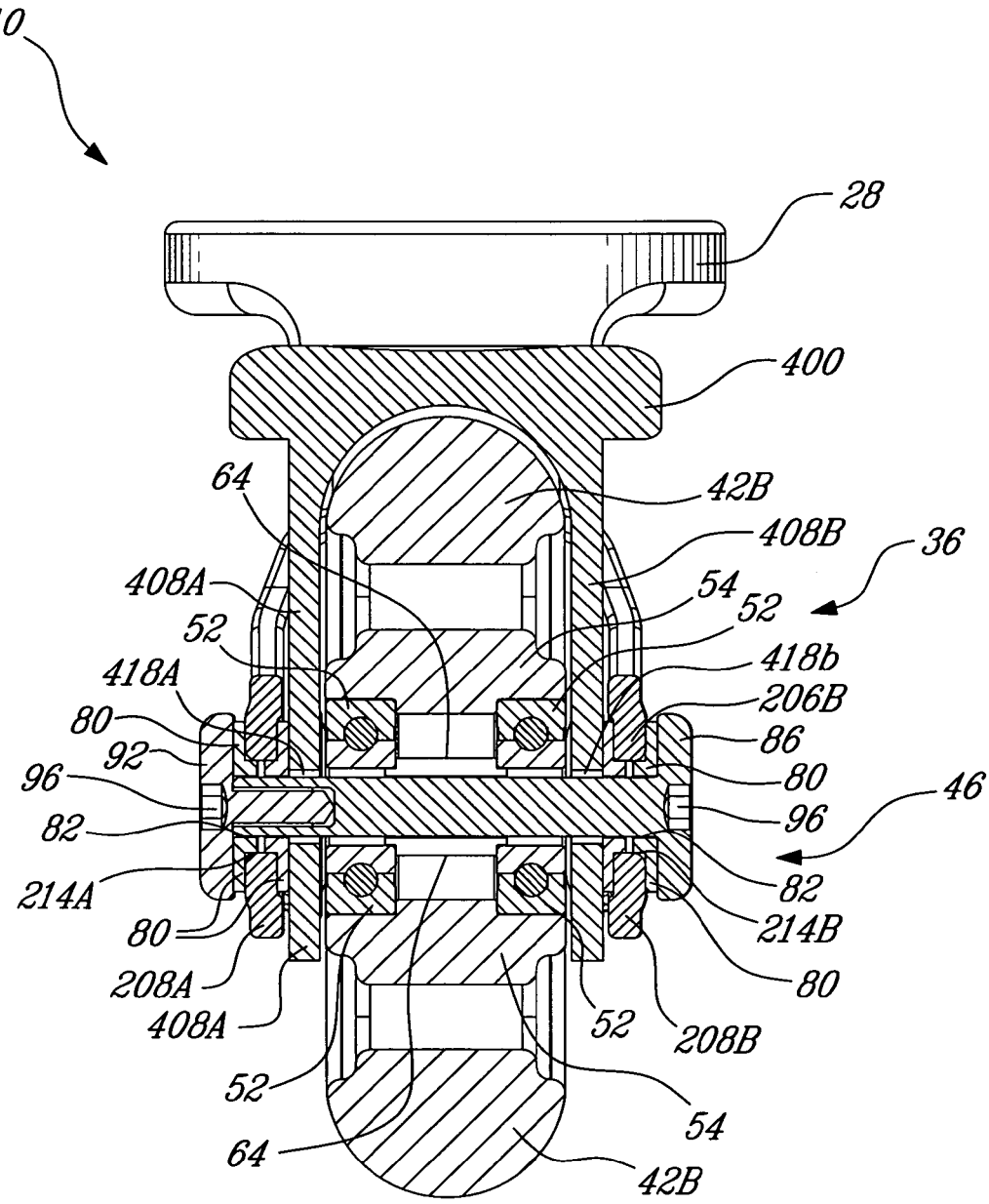
FIG. 3 is a is cross-sectional elevational view taken along the line 3-3 of FIG. 1.

The first arms 206A and 206B are inwardly directed relative to the second arms 208A and 208B and as such the yoke 217 (i.e. the space between plates 212A and 212B) defined by arms 206A and 206B is smaller than the yoke 219 (i.e. the space between plates 216A and 216B) defined by arms 206A and 206B, the reasons for which will be further discussed herein (also see FIGS. 2 and 3).

It should be noted that racks 200 and 300 are similar and in fact almost mirror each other. In one non-restrictive illustrative embodiment, racks 200 and 300 are identical, yet they are oppositely directed. In other words, whereas rack 200 provides a smaller yoke 217 at the front portion thereof and a larger yoke 219 at the rear portion thereof, rack 300 provides a larger yoke 319 (see FIG. 5) at the front portion thereof and a smaller yoke 319 (see FIG. 5) at a rear portion thereof. The skilled artisan will readily appreciate that the same rack 200 or 300 can provide both configurations by merely pointing this same rack 200 or 300 in the other direction.

Keeping the above in mind, the rack 300 will be only briefly discussed for concision purposes only. Referring to FIG. 4, rack 300 includes lateral sides (only one lateral side 302B is shown here, the other being a mirror image thereof being joined by a linking member 304 defining a top surface (not shown). The lateral sides of the rack 300 define a first pair of arms (only arm 306B is shown) and a second pair of arms (only arm 308B is shown here, the other being a mirror image thereof). The first pair of arms include respective plates (only plate 312B is shown here, the other being a mirror image thereof) on their respective free ends providing holes (not shown) for receiving an axle 46. Similarly, the second pair of arms include respective plates (only plate 316A is shown here, the other being a mirror image thereof on their respective free ends providing holes (not shown) for receiving an axle 44.

With reference again to FIG. 4, the main frame body 400 includes a portion thereof having a pair of wheel-receiving arms 408A and 408B having respective holes 418A and 418B for being aligned with holes 218A and 218B of the rack 200, respectively, so as to receive the axle 46. Hence, the two wheel-receiving arms 408A and 408B define a space or yoke 419 therebetween so as to receive wheel 42B. When assembled, the arms 408A and 408B are inserted within yoke 317 defined between arms 208A and 208B of rack 200 so that the holes 218A, 418A, 418B, and 218B are aligned on a same axis 48 so as to receive axle 46, thereby simultaneously rotatably mounting the wheel 42B to both the rack 200 and to the frame main body 400. It should be noted that the wheel-receiving element 36 is defined by the foregoing mating of arms 208A and 208B with arms 408A and 408B.

The main frame body 400 also includes another portion thereof having a second pair of wheel-receiving arms (only arm 428B is shown here, the other being a mirror image thereof) for receiving the wheel 42C with the rack 300 in a similar fashion to that described above. As such, this second pair of arms define a yoke 419 for receiving wheel 42C.

It should be noted that wheel-receiving elements 34 and 40 are similarly constructed; likewise, wheel-receiving elements 36 and 38 are also similarly constructed. Therefore, the descriptions for wheel-receiving elements 34 and 36 are respectively applicable to wheel-receiving elements 38 and 40.

Keeping the above in mind and with reference to FIGS. 2 and 6, wheel-receiving element 34 will now be described.

The roller skate wheel 42A includes a pair of bearing inserts 52 inserted into its wheel hub 54 defining a central aperture 55. The bearing inserts 52 have a respective cylindrical inner race 56, a cylindrical outer race 58 rotatable about the inner race 56, and a set of ball bearings 60 between the inner and outer races, 56 and 58, respectively.

The inner race 56 has an axial bore 62, into which a sleeve 64 is inserted. The sleeve 64 defines a cylindrical aperture 66 for receiving axle 44. Axle 44 includes two body portions 70 and 72. Axle body portion 70 includes a first cap end 74 at one end thereof and defines a cylindrical aperture 76. Axle body portion 72 includes a second cap end 78 at one end thereof and defines a cylindrical insert 79 for being received by the cylindrical aperture 76 when fitting the axle 44 into the wheel-receiving element 34 and when mounting wheel 42A thereto via a screw shaft assembly 68.

The wheel 42A is rotatably attached to the front wheel-receiving element 34 via the axle 44 being simultaneously positioned through the holes 214A and 214B and through sleeve 64 all of which are securely sandwiched in place between cap ends 74 and 78.

Wheel 42D is mounted to the wheel-receiving element 40 in a similar fashion and need not be further described herein for concision purposes only.

Wheels 42A, 42B, 42C and 42D are all similarly constructed and hence, the above description relating to the construction of wheel 42A is applicable to the other three wheels.

With reference to FIGS. 3 and 6, the wheel receiving element 36 will now be described.

The wheel 42B is rotatably mounted to the wheel-receiving element 36 via axle 46, which is simultaneously mounted to aligned holes 218A and 218B, and through sleeve 64. As shown in FIG. 3, the axle 46 is also mounted through a pair of bushings 80 defining respective aligned holes 82 for receiving the axle 46 therethrough. The bushings 80 are mounted within holes 214A and 214B of rack arms 208A and 208B, respectively. With reference to FIGS. 3, 4 and 6 the axle 46 includes a main body 84 having cap end 86 and a cylindrical shape defining an aperture 88. The axle 46 also includes an auxiliary body 90 having a cap end 92 and a tubular insert 94 for being received within the aperture 88 when being connected together via screw shaft assembly 96. Hence, the bushings 80 are sandwiched between cap end 92 and arms 208A and 408A and cap end 86 and arms 208B and 408B. As mentioned above the larger yoke 219 between arms 208A and 208B provides a space for bushings 80. The bushings 80 provide for arms 208A and 208B to pivot about the axis 48 defined by the axle 46 thereby providing a pivot axis to rack 200 which provides the front wheel 42A, when mounted to arms 206A and 206B, to pivot about the axis 48 which is generally orthogonal to the longitudinal axis 12 of the frame 10. Thus the front wheel can be moved towards and away from the shoe of the in-line roller skate.

Wheel 42C is mounted to the wheel-receiving element 38 in a similar fashion. Hence, the rear wheel 42D can also pivot when mounted to the wheel-receiving element 40 similarly to wheel 42A.

Referring to FIGS. 4 and 6, first and second resilient and deformable members 100 are respectively interposed between the racks 200 and 300 and the shoe. More specifically, the resilient and deformable members 100 are each mounted to the top surfaces of the linking-members 204 and 304 of racks 200 and 3001 respectively, (only top surface 210 is shown) and to the underside of the front basis 24 and the rear basis 28 respectively.

The resilient and deformable members 100 may be provided in a variety of flexible and resilient members being so flexible as to be compressed and stretched or extended and so resilient as to be biased against compression and stretching or extension, especially when there is no force exerted thereon. Hence, the resilient and deformable members 100 can be in the form of a piece of rubber or silicon or even a spring member and the like. The skilled artisan can contemplate a variety of resilient deformable members within the context of the present invention.

The resilient and deformable members 100 include a respective central hole 102 for being respectively aligned with the central hole in the top surfaces of the linking-members of each rack 200 and 300 (only hole 211 is shown here). The underside of both of the front basis 24 and the rear basis 28 include holes (not shown) to be aligned with the holes 102 of their respective resilient and deformable members 100. The foregoing sets of aligned holes provide for receiving fasteners (not shown) in order to mount the racks 200 and 300 to the frame main body 400 with deformable members 100 positioned therebetween. In this way, the resilient and deformable members 100 are compressible and stretchable or extendable between the frame 400 (which can form part of the shoe) and the racks 200 and 300.

The resilient and deformable members 100 are so configured as to provide for the wheel-receiving elements 34 and 40 as well as their respective wheels 42A and 42D as previously explained within a predetermined angle range the limits of which are provided between the most compressed position of resilient and deformable member 100 and its most extended or stretched position.

In operation, the user of an in-line roller skate with the wheel-supporting frame 10 varies the pressure exerted by their heel or toe portion of their foot and consequently the pressure exerted on the front basis 24 and the and rear basis 28.

Upon the exertion of a pressure by the front of the foot on the sole of the shoe, the pressure is transmitted to the font basis 24 and then to the front deformable 100' which in turn acts upon the rack 200, which finally acts upon the skating surface. Since the skating surface, in reaction, opposes the pressure exerted thereon, the resilient member 100 is compressed, thus making the rack 200 pivot about the axle 46 thereby bring the leading wheel 42A closer to the shoe. More specifically, the wheel supporting element 34 pivots about axis 48 for an angle determined by that particular force causing the deformable member 100 to compress, such that the front end 14 of frame 10 is projected toward the skating surface. When the pressure exerted by the front of the foot is released, the resilient deformable member 100 tends to resiliently take back its initial form. Therefore, the wheel-receiving element 34 pivots in the opposite direction about axis 48, for an angle determined by the way rack 200 was mounted to the main frame body 400. As such, the front end 14 of frame 10 is projected away from the skating surface since the wheel 42A is moved away from the shoe.

In this manner, the rack 200 is allowed to pivot relative to the main frame body 400. The pivotal movement is restricted: in a first direction, by the ability of the resilient and deformable member 100 to be compressed; and in a second direction, by the ability of the resilient member 600 to resiliently take back its original position or form or to be extended.

In an embodiment, the resilient and deformable member 100 is chosen so that it cannot be compressed such that a part of the main body 400 touches the wheel 42A.

Accordingly, the degree of resiliency of the resilient and deformable member 100 will determine the angle in which the main frame body 400 can pivot relative to the front rack 200.

As the skilled artisan will readily appreciate, the pivotal movement of the rear rack 300 is similar to that of the front rack 200, allowing the rear or trailing wheel 42D to pivot similarly to front wheel 42A, towards and away from the shoe except that the rack 300 provides for a pivoting movement consequent to whether a pressure is exerted or released by the back of the foot on the rear basis 28.

Figure 7:
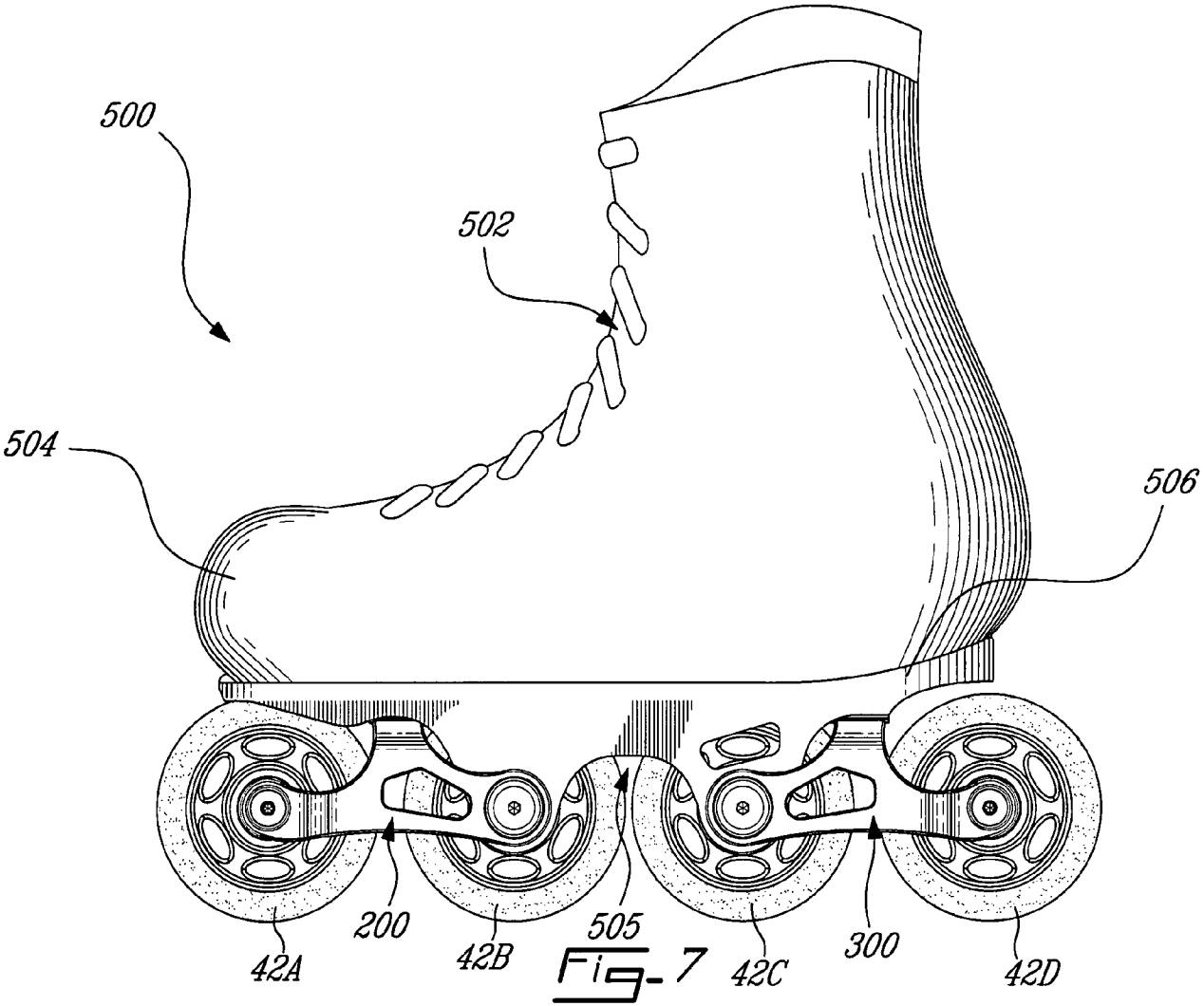
FIG. 7 is a side elevational view of an in-line roller skate in accordance with a non-restrictive illustrative embodiment of the present invention.
Figure 8B:
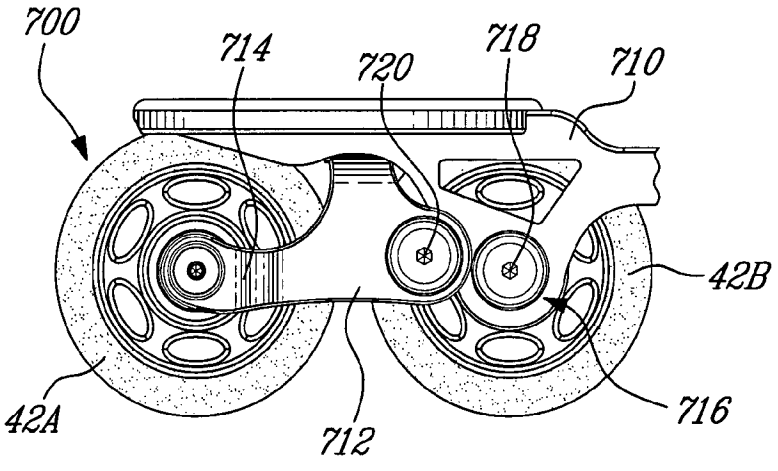
FIG. 8 shows four side elevational partial views of wheel-supporting frames in accordance with four respective non-restrictive illustrative embodiments of the present invention.
Figure 8D:
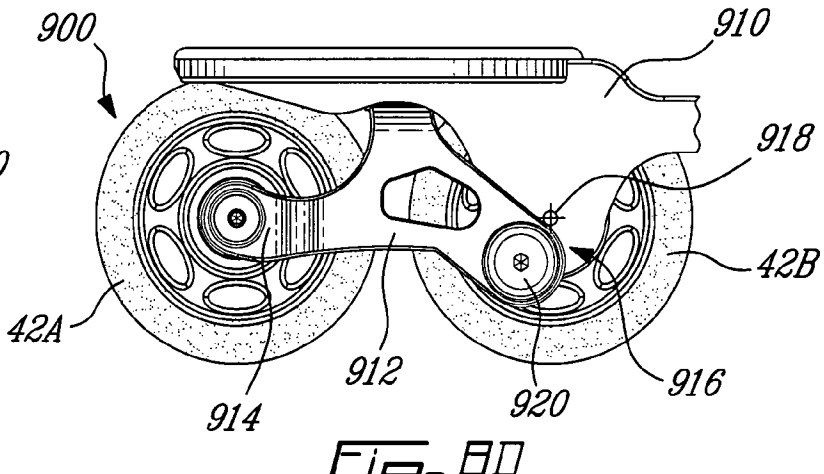
Figure 8A:
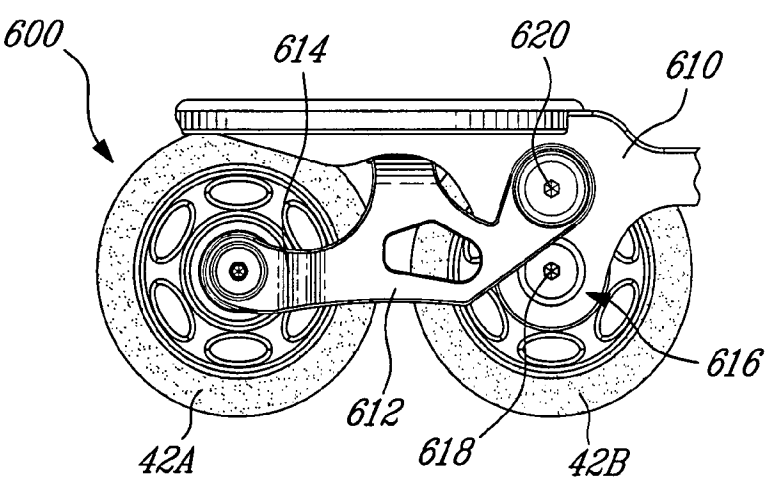
Figure 8C:
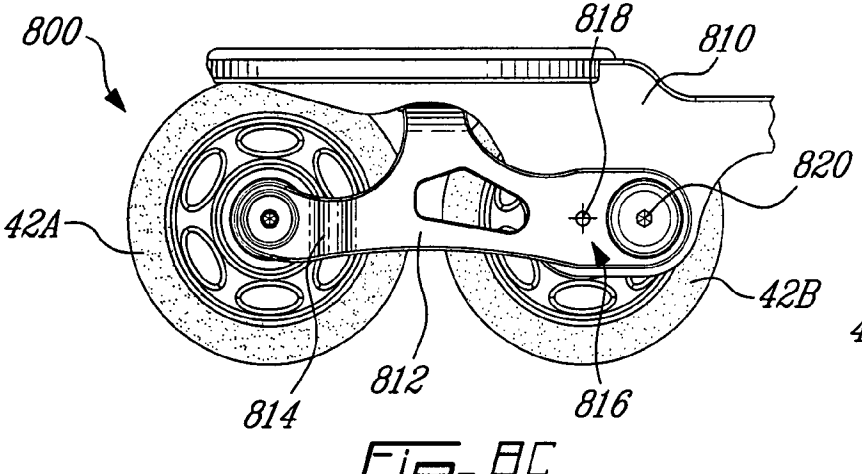

With reference to FIG. 7, an in-line roller skate 500 in accordance non-restrictive embodiment of the present invention will now be described.

The in-line roller skate 500 includes a shoe 502 having a shoe portion 504 and wheel-supporting frame 505 on the underside thereof. The wheel-supporting frame includes main frame body 506. This main frame body 506 is similarly constructed to the main frame body 400 described above with the main difference therewith being that it is integral with the shoe portion 504, thereby defining the shoe 502. The auxiliary frame bodies or racks 200 and 300 are mounted to the main frame body 506 similarly to the way they were mounted to the main frame body 400.

Turning now to FIG. 8, various wheel-supporting frames 600, 700, 800 and 900 are shown in a accordance with non-restrictive illustrative embodiments of the present invention.

Wheel-supporting frames 600, 700, 800 and 900 include respective main frame bodies 610, 710, 810, and 910 having front auxiliary frame bodies or racks 612, 712, 812, and 912 respectively mounted thereto. Each wheel-supporting frame 600, 700, 800 and 900 provides a respective pair of wheel-receiving elements 614 and 616, 714 and 716, 814 and 816, and 914 and 916. The wheel-receiving elements 614, 714, 814, and 914 receive a respective wheel 42A. The wheel-receiving elements 616, 716, 816, and 916 receive a respective wheel 42B and define a respective wheel axis of rotation 618, 718, 818, and 918. In these examples, the pivoting axis 620, 720, 820, and 920 or each wheel-receiving element 614, 714, 814, and 914 respectively is not coaxial with the respective rotating axis 618, 718, 818, and 918 of wheel 42B. More specifically: for frame 600, the pivot axis 620 is positioned above the axis of rotation 618; for frame 700, the pivot axis 720 is positioned before the axis of rotation 718; for frame 800, the pivot axis 820 is positioned after the axis of rotation 818; and for frame 900, the pivot axis 920 is positioned below the axis of rotation 918.

With reference to FIGS. 9 to 18, a wheel-supporting frame 1010 for an in-line roller skate according to another non-restrictive illustrative embodiment of the present invention will now be described.

Figure 9:
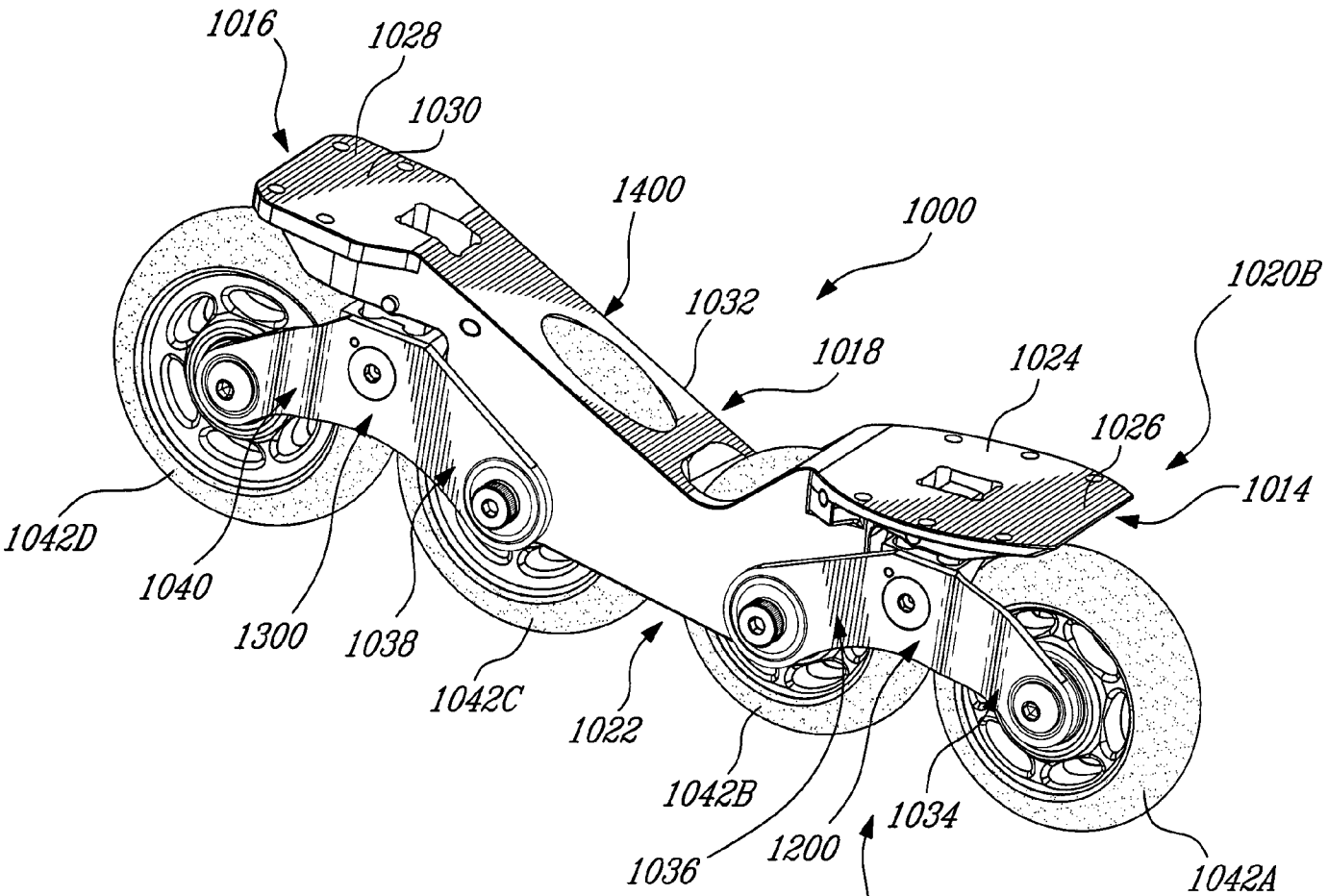
FIG. 9 is a perspective view a wheel-supporting frame for an in-line roller skate according to another non-restrictive illustrative embodiment of the present invention.
Figure 10:
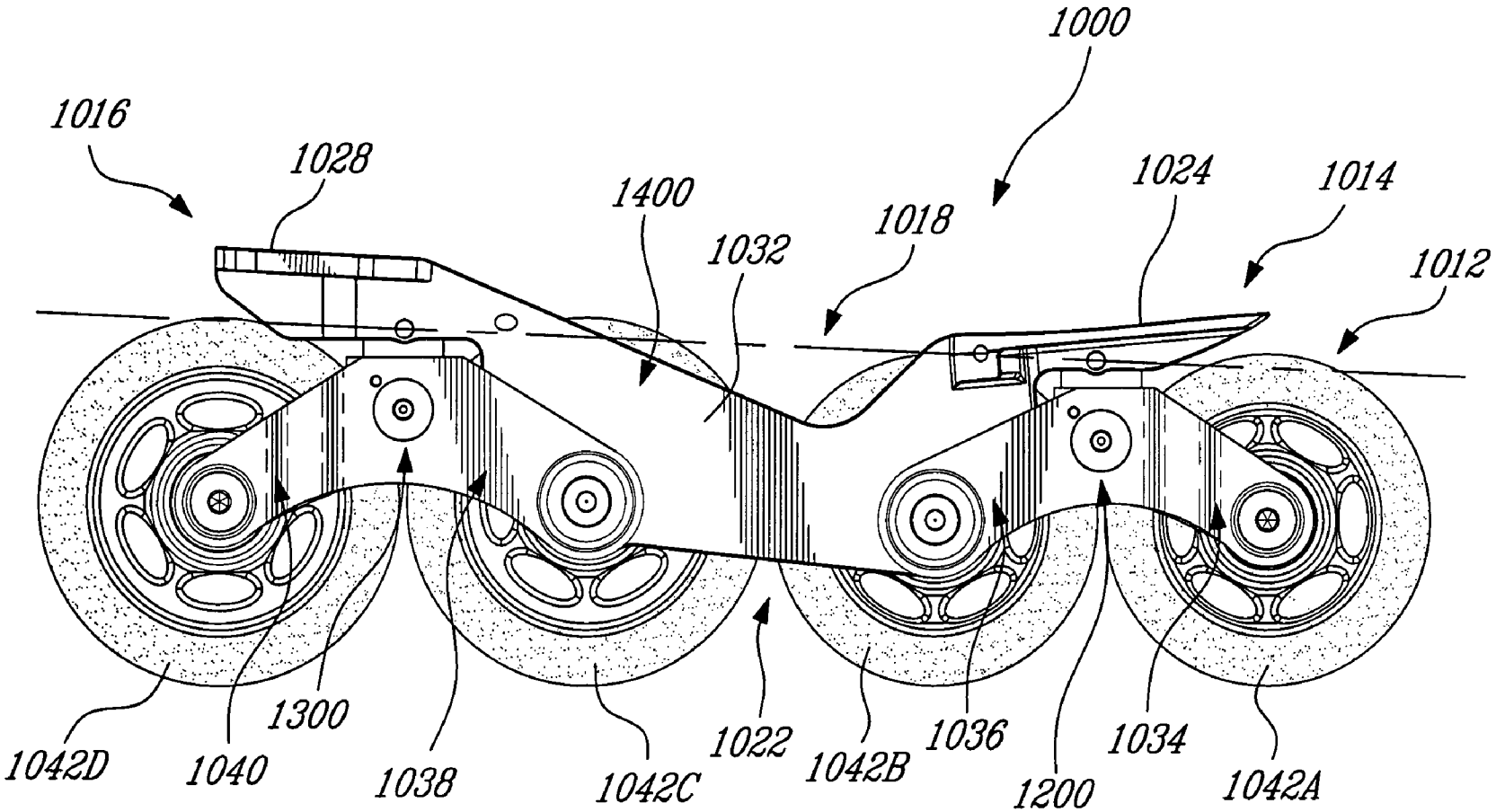
FIG. 10 is a side elevational view of the a wheel-supporting frame of FIG. 9.

FIGS. 9 and 10 show the wheel-supporting frame 1010 generally defining a longitudinal axis 1012 extending from a front end 1014 thereof to a rear end 1016 thereof comprising a shoe-mounting side 1018 and an opposite wheel-supporting side 1022. As can be better seen on FIG. 12, the wheel-supporting frame 1010 also includes opposite lateral sides 1020A and 1020B. Turning back to FIGS. 9 and 10, the shoe-mounting side 1018 has a front basis 1024 including a top surface 1026 and a rear basis 1028 including a top surface 1030 as well as a median portion 1032 therebetween.

The wheel-supporting frame 1010 comprises a plurality of aligned wheel-receiving elements 1034, 1036, 1038 and 1040 for respectively receiving wheels 1042A, 1042B, 1042C and 1042D. Wheel-receiving elements 1034 and 1036 form part of a front wheel receiving member or rack 1200 and wheel-receiving elements 1038 and 1040 form part of a rear wheel-receiving member or rack 1300. Hence, the front rack 1200 receives wheels 1042A and 1042B and the rear rack 1300 receives wheels 1042C and 1042D.

Racks 1200 and 1300 are auxiliary frame bodies mounted to a main frame body 1400

Figure 11:
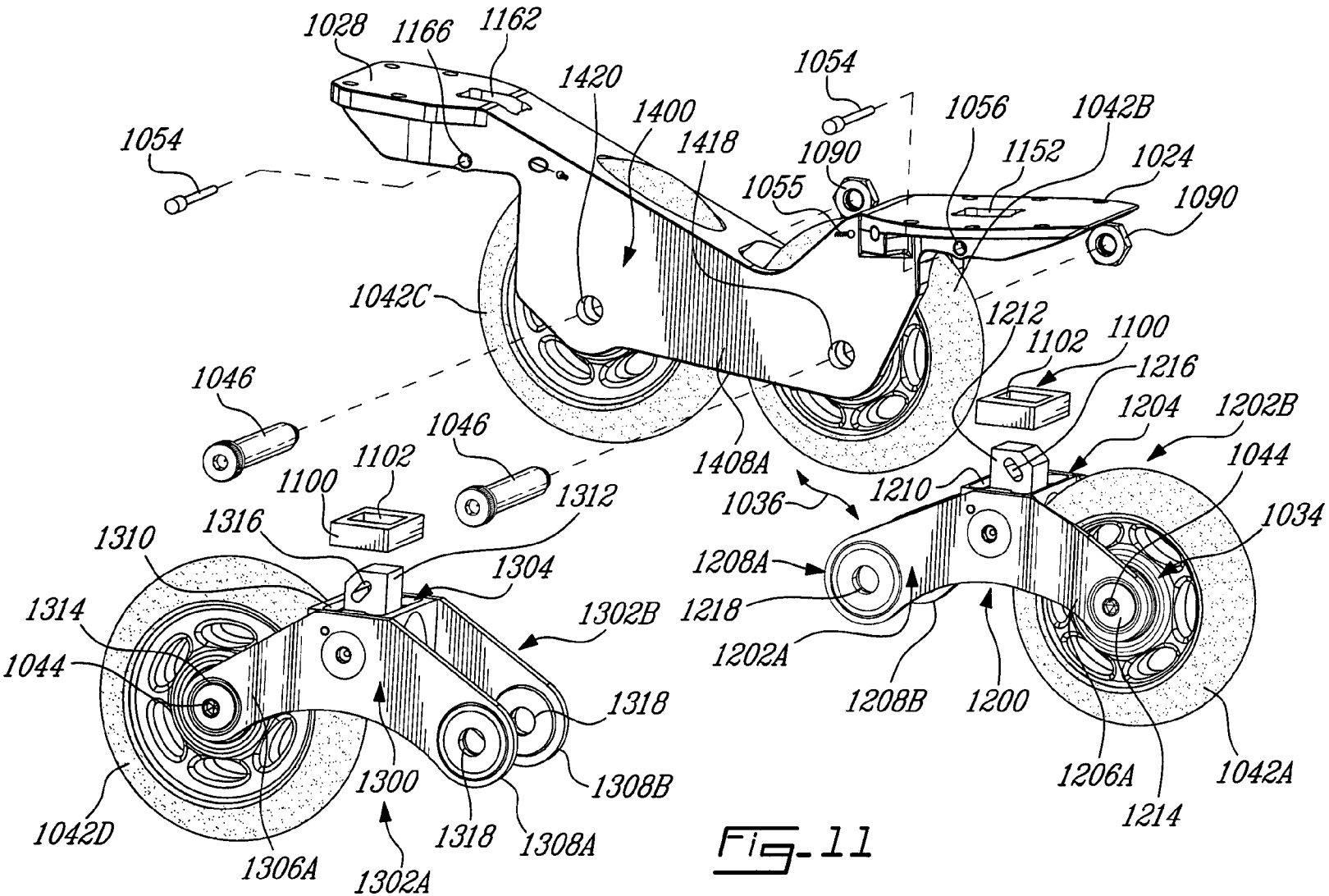
FIG. 11 is an exploded perspective view of the wheel-supporting frame of FIG. 9.
Figure 12:
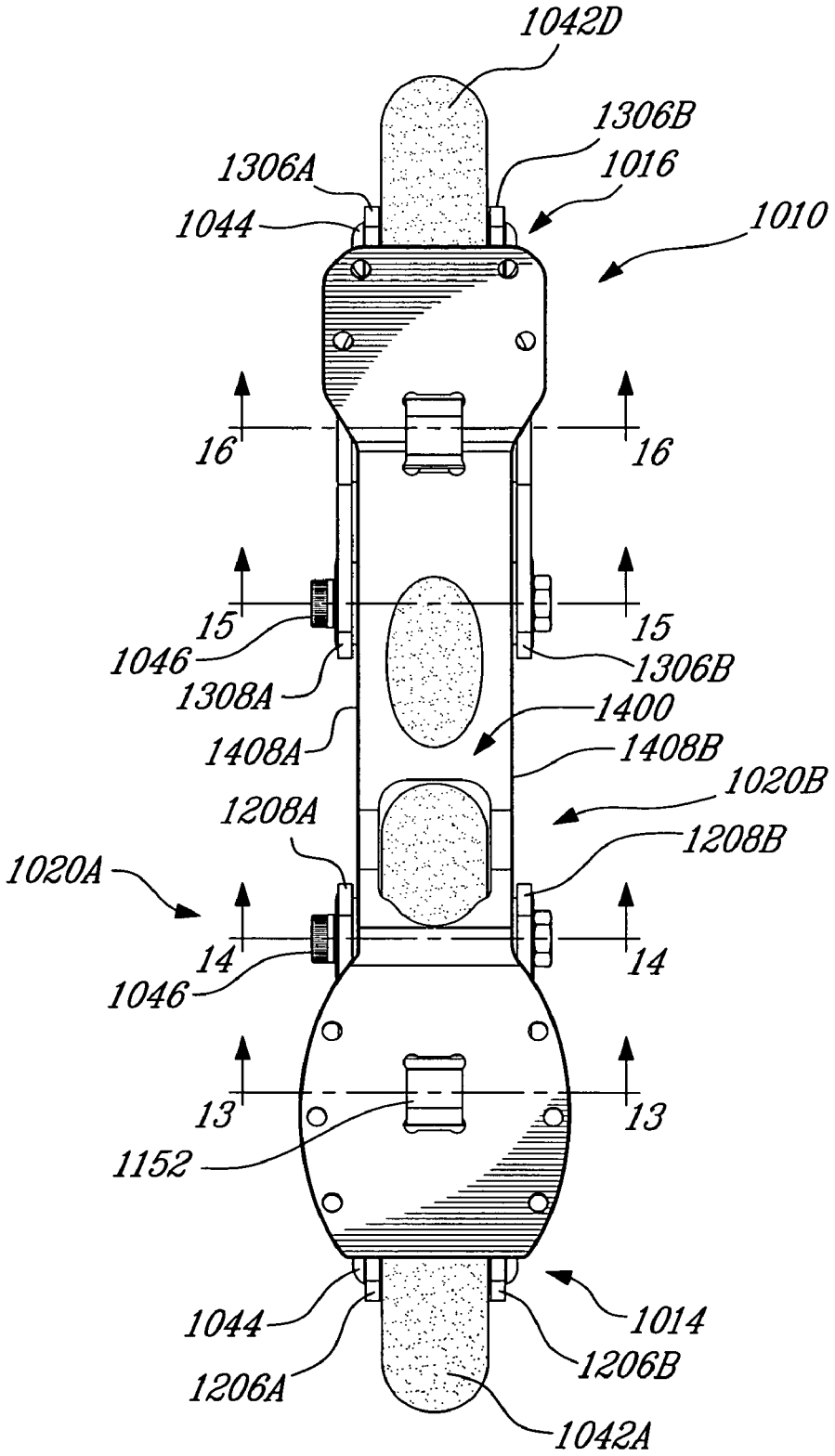
FIG. 12 is a top plan view of the wheel-supporting frame of FIG. 9.

With particular reference to FIGS. 11 and 12, the front rack 1200 includes a pair of lateral sides 1202A and 1202B joined together via linking-member 1204. The lateral sides 1202A and 1202B include a first pair of arms 1206A and 1206B (see FIG. 12), defining the wheel-receiving element 1034, and a second pair of arms 1208A and 1208B, defining the wheel-receiving element 1036. The first pair of arms 1206A and 1206B include respective holes 1214 for receiving a first pivot axle 1044. The second pair of arms 208A and 208B include respective holes 1218 for receiving a second pivot axle 1046. The first arms 1206A and 1206B are inwardly directed relative to the second arms 1208A and 1208B and as such the yoke defined thereby is smaller than the yoke defined by the second arms 1208A and 1208B.

The linking-member 1204 includes a top open face 1210 thereof having a tab member 1212 protruding therefrom and including a slanted slit 1216. The open top 1210 face receives a resilient and deformable member 1100 therein having an opening 1102

Rack 1300 includes lateral sides 1302A and 1302B joined by a linking member 1304 defining a top open face 1310 having tab member 1312 protruding therefrom with a slanted slit 1316. The open top face 1310 receives a resilient deformable member 1100 which includes an opening 1102 for the tab member 1312. Rack 300 includes a first pair of arms 1308A and 1308B, having respective holes 1318 for a receiving an axle 1046 and a second pair of arms 1306A and 1306B having respective holes 1314 for receiving an axle 1044.

Again, the resilient and deformable member 1100 is interposed between a rack 1200 and 1300 and the shoe.

The main frame body 1400 includes a pair of opposite panels 1408A and 1408B having respective front holes 1418 for being aligned with holes 1218 of the rack 1200, so as to receive the axle 1046 and wheel 1042B. The panels 1408A and 1408B also include respective rear holes 1420 for being aligned with holes 1318 of rack 1300. Hence, the panels 1408A and 1408B are positioned within the yokes defined by arms 1208A and 1208B of rack 1200 and by arms 1308A and 1308B of rack 1300.

The wheel receiving elements 1036 and 1038 will now be described in greater detail with reference to FIGS. 14 and 15.

Figure 14:
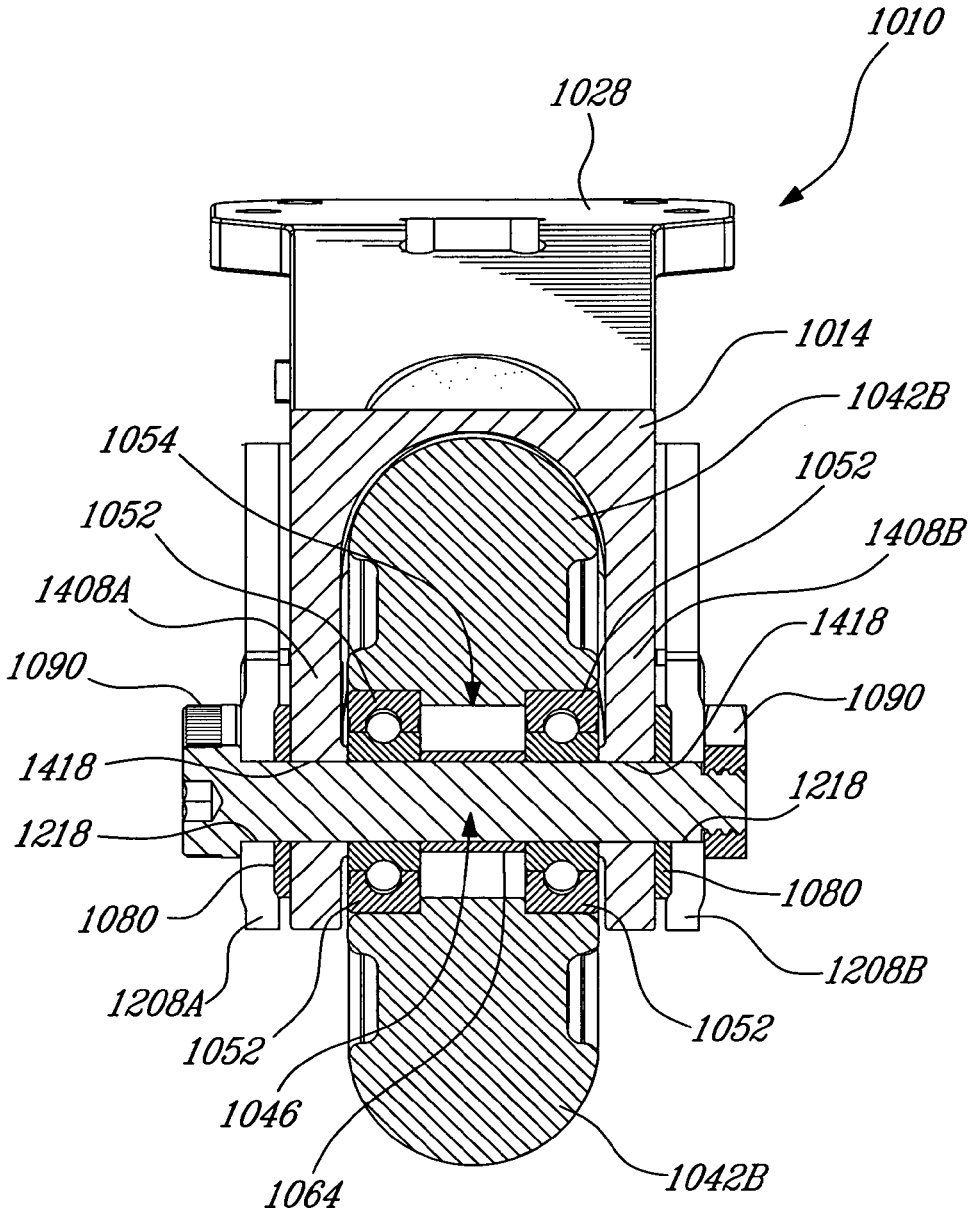
FIG. 14 is a front sectional view of FIG. 12 along line 14-14.

With reference to FIG. 14, roller skate 1042B includes a pair of bearing inserts 1052 inserted into its wheel hub 1054 having a sleeve 1064 and is rotatably mounted to the wheel-receiving element 1036 via axle 1046. The axle 1046 is simultaneously mounted to aligned holes 1218 and 1418 and bushings 1080 and hub 1054 and is secured to the frame 1010 via fasteners 1090 (such as nut and bolt assemblies) at each longitudinal end thereof. The bushings 1080 provide for arms 1208A and 1208B to pivot about the axle 1046 providing the wheel receiving element 1034 carrying wheel 1042A to pivot about the axis defined by axle 1046.

Figure 15:
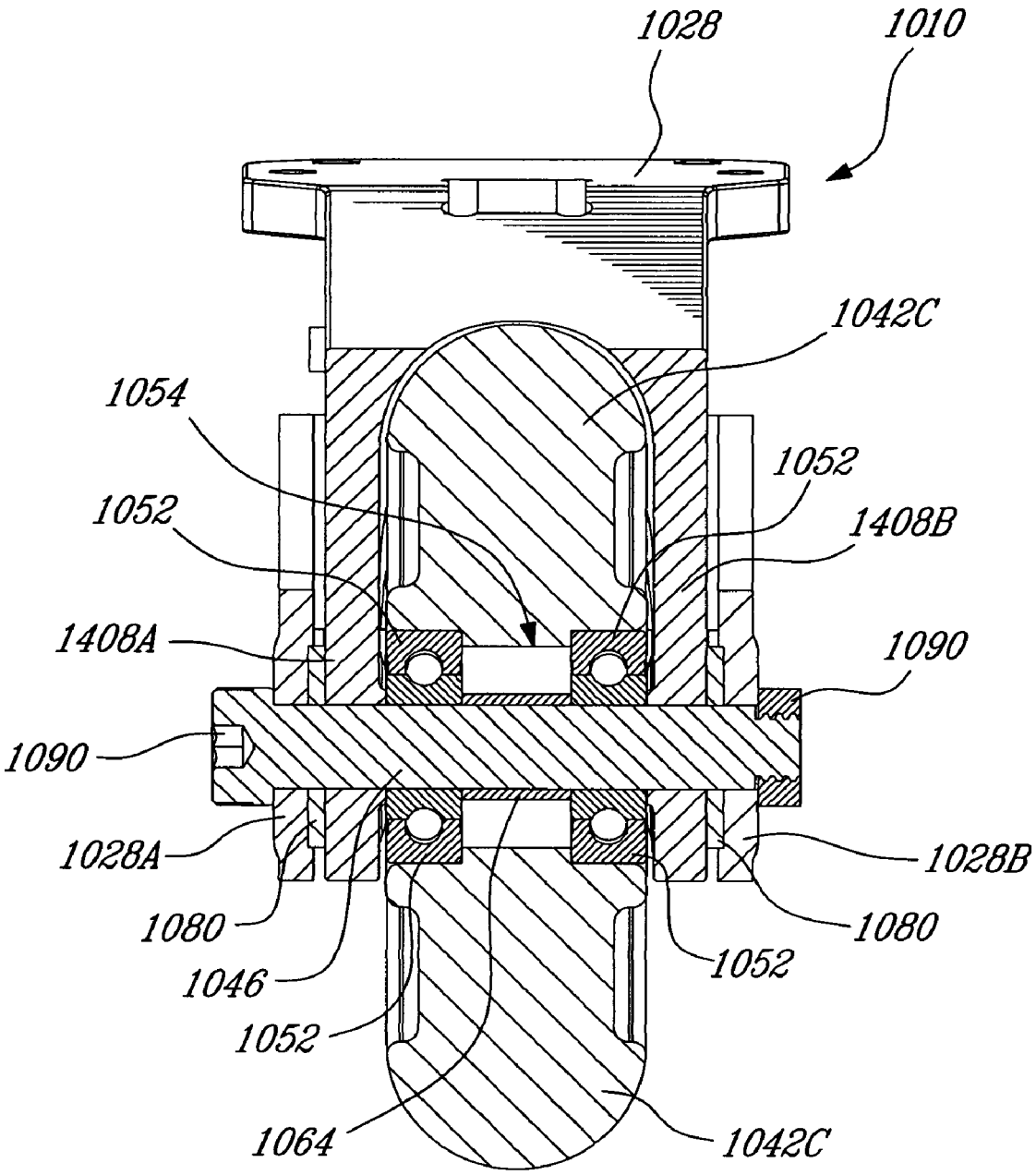
FIG. 15 is a front sectional view of FIG. 12 along line 15-15.

With reference to FIG. 15, the wheel 1042C is mounted to the wheel-receiving element 1038 in a similar fashion about axle 1046. Hence, the rear wheel 1042D can also pivot along the wheel-receiving element 1040 about the axis defined by axle 1046.

With reference to FIGS. 11, 13, 16 and 18 the connection of the racks 1200 and 1300 to the main body 1400 will be described in further detail.

Figure 13:
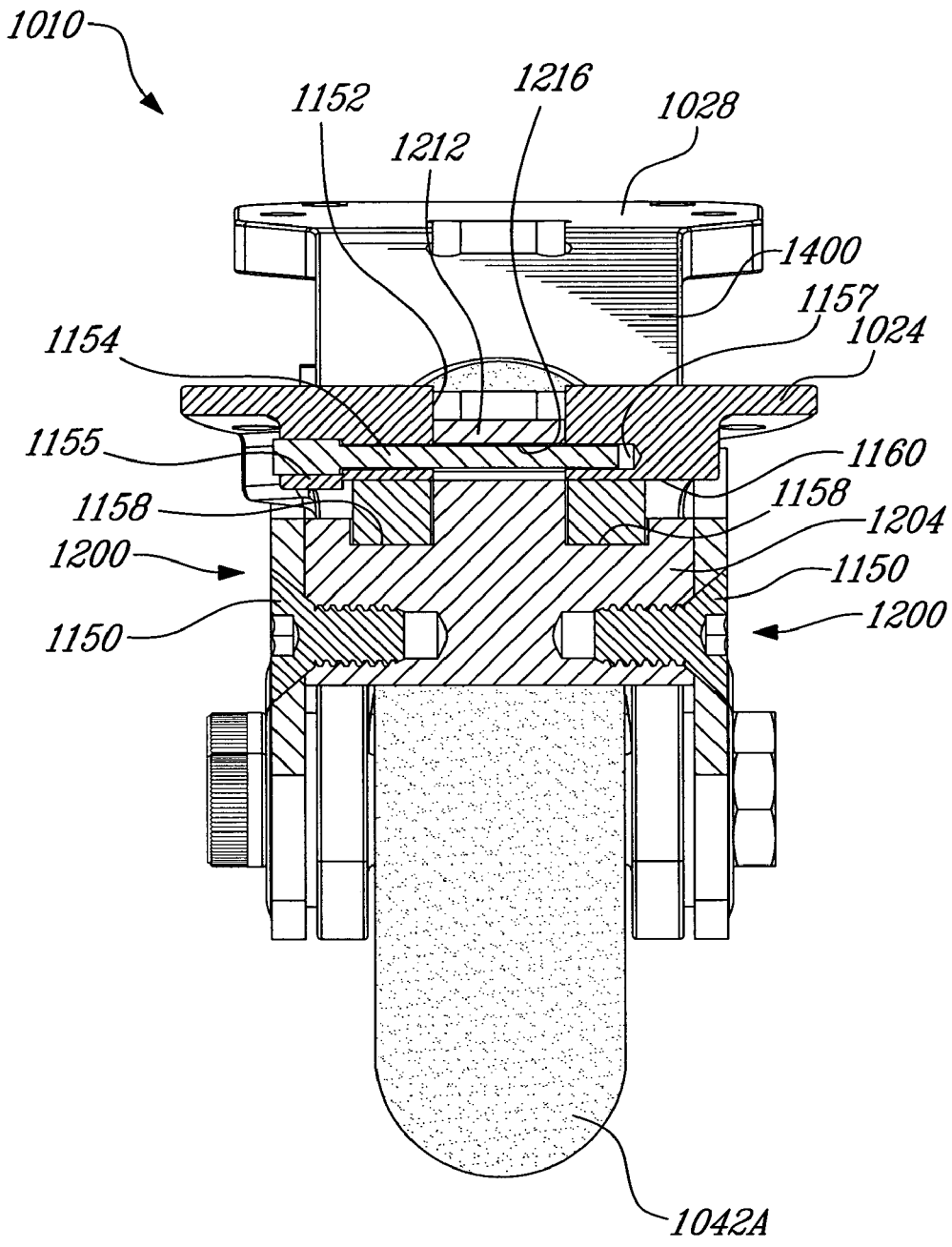
FIG. 13 is a front sectional view of FIG. 12 along line 13-13.

Referring particularly to FIG. 13, sides 1202A and 1202B of the rack 1200 are mounted to the linking member 1204 via fasteners 1150. The protruding tab member 1212 extending from the open top face 1210 of the linking member 1204 is positioned within an opening 1152 (see also FIGS. 11, 12 and 18) of the front basis 1024. A pin member 1154 fastened at one end by a sleeve 1155 is inserted via the side hole 1156 of the basis 1024 through the slit 1216 of the tab member 1212 and fastened at the other end in an aperture 1056 machined within the basis 1024. The resilient and deformable body 1100 is mounted about the tab member 1212 and sandwiched between the floor 1158 of the linking member 1204 and the underside 1160 of the basis 1024.

Figure 16:
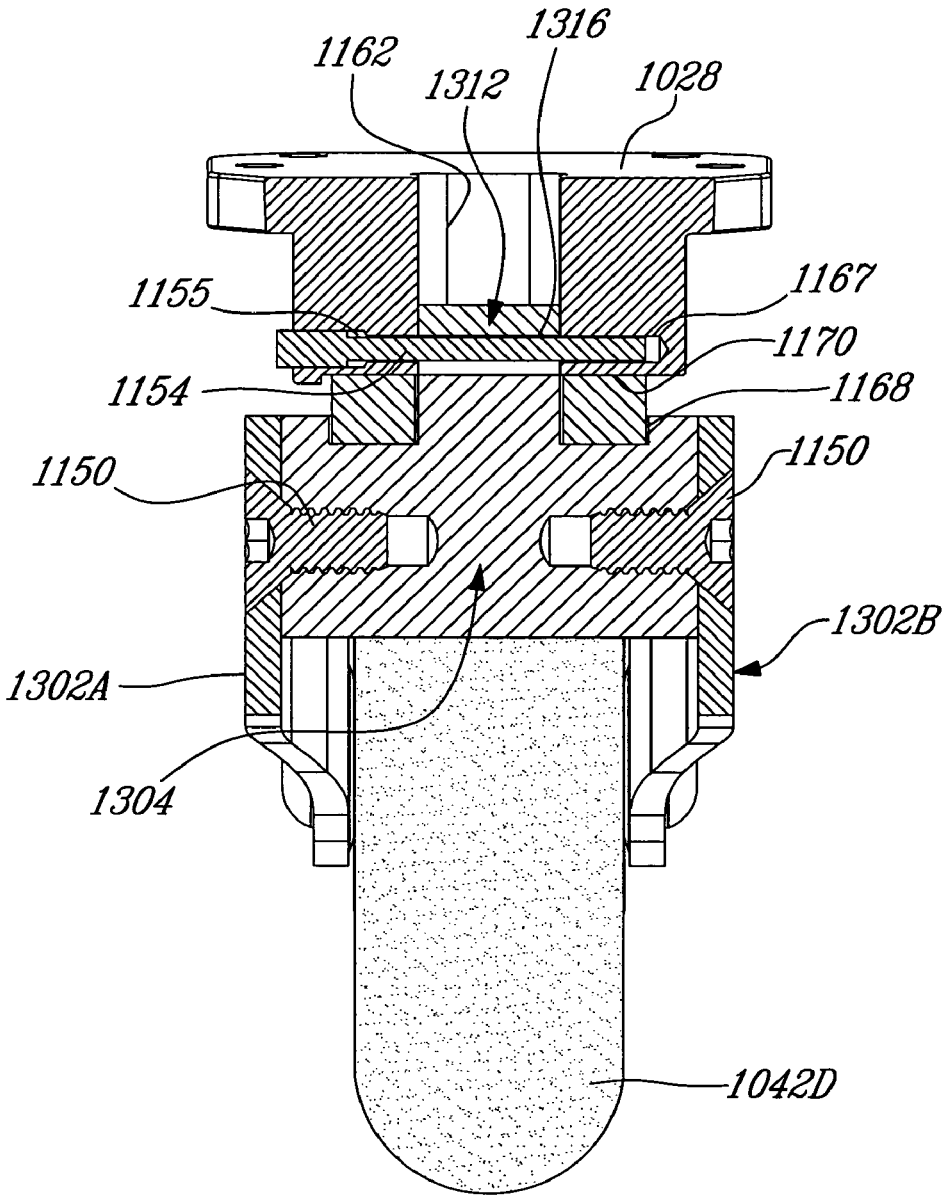
FIG. 16 is a front sectional view of FIG. 12 along line 16-16.
Figure 17:
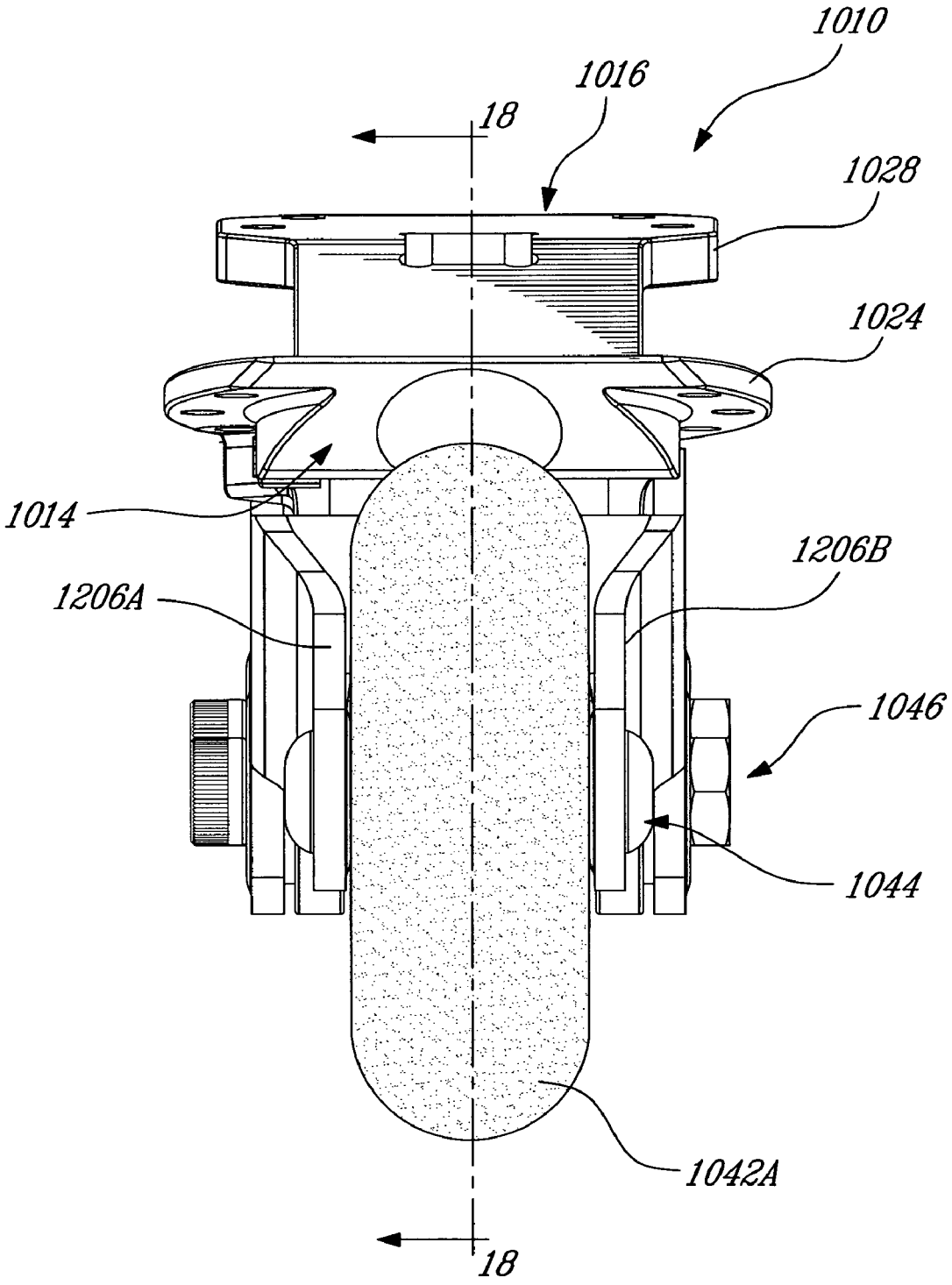
FIG. 17 is a front elevational view of the wheel-supporting frame of FIG. 9.
Figure 18:
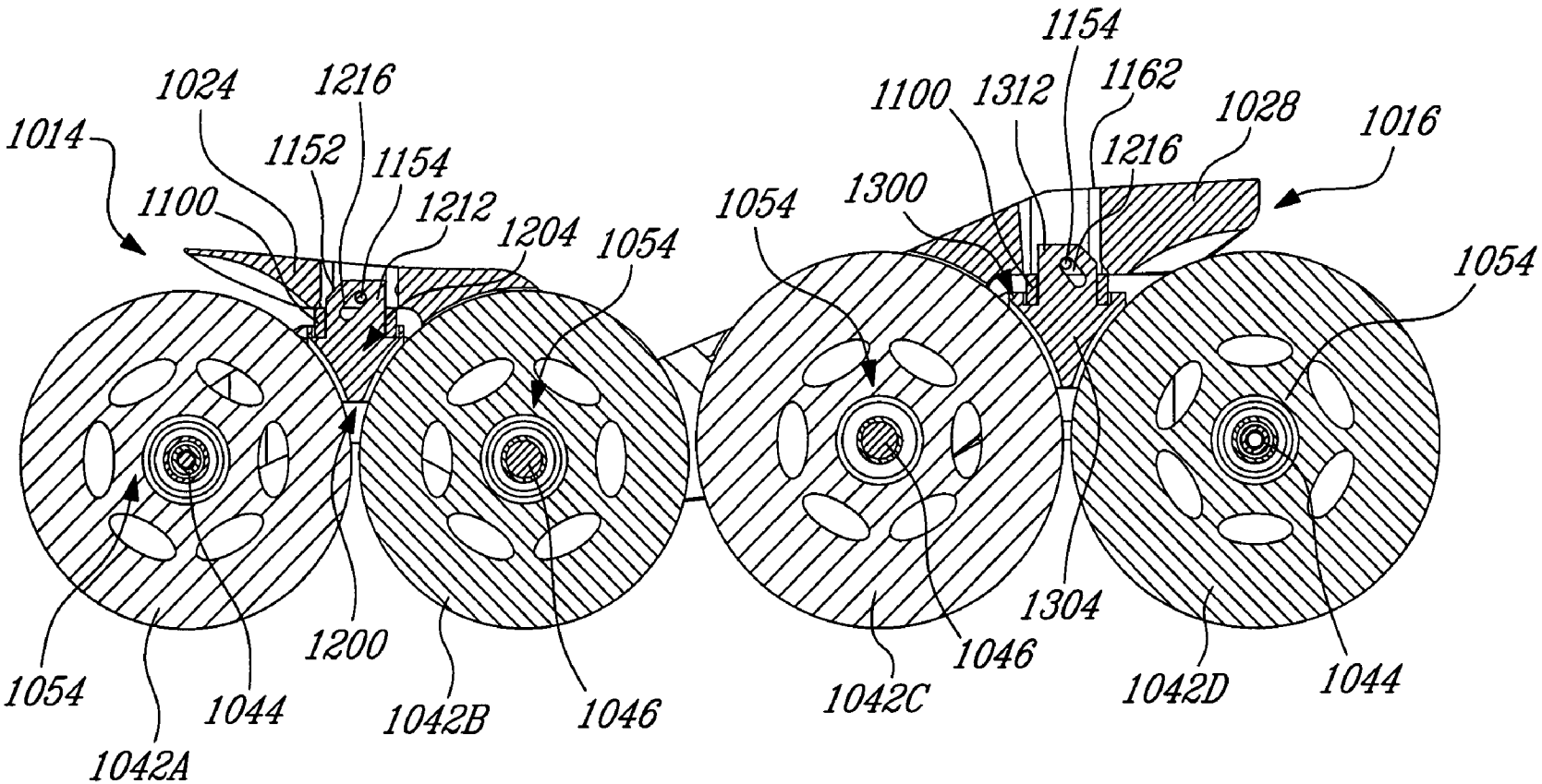
FIG. 18 is a side sectional view of FIG. 17 along line 18-18.

Referring particularly to FIG. 16, sides 1302A and 1302B of the rack 1300 are mounted to the linking member 1304 via fasteners 1150. The protruding tab member 1312 extending from the open top face 1310 of the linking member 1304 is positioned within an opening 1162 (see also FIGS. 11, 12 and 18) of the rear basis 1028. A pin member 1154 fastened at one end by a sleeve 1155 is inserted via the side hole 1166 of the basis 1024 through the slit 1316 of the tab member 1312 and fastened at the other end in an aperture 1167 machined within the basis 1026. The resilient and deformable body 1100 is mounted about the tab member 1312 and sandwiched between the floor 1168 of the linking member 1304 and the underside 1170 of the basis 1028.

As previously explained, upon the exertion of a pressure by the front of the foot on the sole of the shoe, the pressure is transmitted to the font basis 1024 and then to the front resilient and deformable member 1100, which in turn acts upon the rack 1200, which finally acts upon the skating surface. Since the skating surface, in reaction, opposes the pressure exerted thereon, the resilient deformable member 100 is compressed, thus making the rack 1200 pivot about the axle 1046 bringing its wheel 1042A towards the shoe. More specifically, the wheel supporting element 1034 pivots upwardly relative to the main body 1400 for an angle determined by that particular force causing the resilient and deformable member 1100 to compress, such that the front end 1014 of frame 1010 is projected toward the skating surface. In tandem, the front tab member 1212 moves upwardly as its slit 1216 is guided by pin 1154 adding stability to the frame 1010 against unwanted vibrations. When the pressure exerted by the front of the foot is released, the deformable member 1100 tends to resiliently take back its initial form. Therefore, the wheel-receiving element 1034 pivots downwardly for an angle determined by the way rack 200 was mounted to the main body 400. As such, the front end 14 of frame 10 is projected away from the skating surface. In tandem, the front tab member 1212 moves downwardly along pin 1154. As mentioned, the pivotal movement of the rear rack 1300 is similar to that of the front rack 1200, allowing the rear wheel 1042D to pivot similarly to front wheel 1042A, except that the rack 1300 provides for a pivoting movement consequent to whether a pressure is exerted or released by the back of the foot on the rear basis 1028.

It is understood that it is within the reach of those skilled in the art to pivotably mount the racks of the invention to the frames of the invention by other ways other than the use of axles.

It should be also understood that any of the wheel-receiving elements can be pivoted along an axis that is orthogonal to the longitudinal axis of the wheel supporting frame (or the shoe). Hence, other wheel-receiving elements can also be contemplated. In one example, a wheel-receiving element includes a pair of arms for receiving a wheel therebetween. The arms are pivotally mounted to the wheel-supporting frame.

In another embodiment, the pivotable movement of the wheel-receiving elements can be predetermined by other ways than the use of a deformable member. The skilled artisan can contemplate a variety of constructions which limit pivoting within a predetermined angle range.

The various embodiments and features or characteristics thereof discussed and/or illustrated herein can be combined in a variety of ways by the person having skill in the art in order to provide still other embodiments within the scope of the present invention.

Hence, although the present invention has been described hereinabove by way of non-restrictive, illustrative embodiments thereof, these embodiments can be modified at will, within the scope of the disclosure without departing from the spirit and nature of the subject invention as defined in the claims.

What is claimed is:

1. An in-line roller skate comprising:

a shoe; and a wheel supporting frame extending from said shoe for supporting aligned wheels and comprising:

a main frame body mounted to said shoe, said main frame comprising first and second pairs of wheel-receiving arms for rotatably receiving respective wheels and shafts;

a first auxiliary frame body comprising a first pair of arms for rotatably receiving a leading wheel and a shaft and a second pair of arms for being pivotally mounted to the shaft of the wheel received by one of said first and second main frame wheel-receiving arms and adjacent to the wheel received by said auxiliary frame;

a first resilient and deformable member interposed between said first auxiliary frame body and said shoe and between the two adjacent wheels for extension and compression along the vertical distance between said auxiliary frame body and said shoe;

a second auxiliary frame body pivotally mounted to said main frame body and carrying a trailing wheel;

a second resilient and deformable member being interposed between said second auxiliary frame body and said shoe, wherein said first auxiliary frame body is so pivotable as to provide for moving said leading wheel towards and away from said shoe for a distance determined by the extension and compression of said first resilient and deformable member, said second auxiliary frame body being so pivotable as to provide for moving said trailing wheel towards and away from said shoe for a distance determined by the extension and compression of said second resilient and deformable member.

2. An in-line roller skate according to claim 1 wherein at least one of said first and second resilient and deformable members is respectively mounted between said main frame body and said first and second auxiliary frame bodies.

3. An in-line roller skate according to claim 1, wherein at least one of first and second said auxiliary frame members comprises a pair of lateral sides and a linking member therebetween.

4. An in-line roller skate according to claim 3, wherein at least one of said first and second resilient and deformable members is mounted to said linking member.

5. An in-line roller skate according to claim 4, wherein at least one of said resilient and deformable members is mounted to an underside of said main frame body.

6. An inline roller skate according to claim 4, wherein said linking member comprises a tab member upwardly protruding therefrom, at least one of said first and second resilient and deformable members receiving said tab member therethrough, said tab member being movably mounted to said main frame body.

7. An in-line roller skate according to claim 6, wherein said main frame body comprises a pin member, said tab member comprising a slit for receiving said pin member therethrough, said slit being so configured as to provide for said tab member to move upwardly and downwardly along said pin during pivoting movement of at least one of said first and second auxiliary frame members.

8. A wheel-supporting frame for an in-line skate having a shoe, said frame comprising:

a main frame body mountable to the shoe;

a first auxiliary frame body for supporting a leading wheel and being pivotally mounted to said main frame body;

a first resilient and deformable member for being interposed between the underside of said main frame body and the top face of said first auxiliary frame body and for being positioned directly beneath the shoe, said main frame body underside and said first resilient and deformable member comprise respective openings for receiving therein a tab member extending from said first auxiliary frame body top face and comprising a slit for receiving a pin member mounted to said main frame body, said slit and said pin being positioned directly beneath the shoe when said wheel-supporting frame is mounted thereto, said first auxiliary frame body comprising a recessed floor surrounding said tab thereby providing a cavity for receiving a portion of said resilient and deformable member;

a second auxiliary frame body pivotally mounted to said main frame body and carrying a trailing wheel; and a second resilient and deformable member being interposable between said second auxiliary frame body and the shoe, wherein said first auxiliary frame body is so pivotable as to provide for moving said leading wheel towards and away from said shoe for a distance determined by the movement of said tab member along said pin member and by the compression of said resilient and deformable member, said second auxiliary frame body being so pivotable as to provide for moving said trailing wheel towards and away from said shoe for a distance determined by the extension and compression of said second resilient and deformable member.

9. A wheel-supporting frame according to claim 8 wherein said pin member extends through said opening.

10. A wheel-supporting frame according to claim 8, wherein said first auxiliary frame member further comprises a pair of lateral sides and a linking member therebetween, said linking member defining said top face.

11. A wheel-supporting frame according to claim 10, wherein said lateral sides comprise respective wheel-receiving arms for rotatably receiving a wheel therebewteen.

12. A wheel-supporting frame according to claim 11, wherein said lateral sides comprises respective second arms for rotatably receiving a portion of said main frame body therebetween.

13. A wheel-supporting frame according to claim 12, wherein said portion of said main frame comprises a wheel rotatably mounted to a shaft, said respective second arms being rotatably mounted to said shaft.

14. A wheel-supporting frame according to claim 8, wherein, said slit is so configured as to provide for said tab member to move upwardly and downwardly along said pin during pivoting movement of said auxiliary frame member.

15. An in-line roller skate comprising:

a shoe; and a wheel supporting frame extending from said shoe for supporting aligned wheels and comprising:

a main frame body mountable to said shoe;

at least one auxiliary frame body for supporting a wheel and being pivotally mounted to said main frame body; and a resilient and deformable member for being interposed between the underside of said main frame body and the top face of said auxiliary frame body and being positioned directly beneath said shoe, said main frame body underside and said resilient and deformable member comprise respective openings for receiving therein a tab member extending from said auxiliary frame body top face and comprising a slit for receiving a pin member mounted to said main frame body, said slit and said pin being positioned directly beneath said shoe, said auxiliary frame body comprising a recessed floor surrounding said tab thereby providing a cavity for receiving a portion of said resilient and deformable member, wherein said at least one auxiliary frame body is so pivotable as to provide for moving said wheel towards and away from said shoe for a distance determined by the movement of said tab member along said pin member and by the compression of said resilient and deformable member and wherein said main frame and auxiliary frame bodies support a respective wheel, said in-line roller skate being further characterized in that the pivot axis of said auxiliary frame body about said main frame body is offset relative to the axis of rotation of the wheel supported by said main frame body.

16. An in-line roller skate according to claim 15 wherein said pin member extends through said opening.

17. An in-line roller skate according to claim 15, wherein said auxiliary frame member further comprises a pair of lateral sides and a linking member therebetween, said linking member defining said top face.

18. An in-line roller skate according to claim 15, wherein said auxiliary frame body top face is open so as to receive said resilient and deformable member therein.

19. An in-line roller skate according to claim 15, wherein said auxiliary frame body pivot axis is positioned above said axis of rotation.

20. An in-line roller skate according to claim 15, wherein said shoe defines a front end and a rear end thereof along its longitudinal length, said auxiliary frame body pivot axis being positioned between said shoe front end and said axis of rotation.

21. An in-line roller skate according to claim 15, wherein said shoe defines a front end and a rear end thereof along its longitudinal length, said auxiliary frame body pivot axis being positioned between said shoe rear end and said axis of rotation.

22. An in-line roller skate according to claim 15, wherein said auxiliary frame body pivot axis is positioned below said axis of rotation.

23. An in-line roller skate comprising:

a shoe; and a wheel supporting frame extending from said shoe for supporting aligned wheels and comprising:

a main frame body mountable to said shoe for supporting at least one wheel;

a first auxiliary frame body for supporting a leading wheel and being pivotally mounted to said main frame body about a first pivot having a pivot axis that is adjacent the pivot axis of the leading wheel;

a first resilient and deformable member interposed between the underside of said main frame body and the top face of said first auxiliary frame body and being positioned directly beneath said shoe;

a second auxiliary frame body for supporting a trailing wheel and being pivotally mounted to said main frame body about a second pivot having a pivot axis that is adjacent the pivot axis of the trailing wheel;

a second resilient and deformable member interposed between the underside of said main frame body and the top face of said second auxiliary frame body and being positioned directly beneath said shoe;

wherein said first auxiliary frame body is so pivotable as to provide for moving said leading wheel towards and away from said shoe for a distance determined by the extension and compression of said first resilient and deformable member, said second auxiliary frame body being so pivotable as to provide for moving said trailing wheel towards and away from said shoe for a distance determined by the extension and compression of said second resilient and deformable member, and wherein the positioning of said first and second resilient and deformable members is selected from the group consisting of: (i) said first resilient and deformable member being positioned between the first pivot axis and the leading wheel pivot axis, (ii) said second resilient and deformable member being positioned between the second pivot axis and the leading wheel pivot axis, and (iii) a combination of (i) and (ii).

* * * * *